US010994889B1

(12) United States Patent
Rumsam et al.

(10) Patent No.: US 10,994,889 B1
(45) Date of Patent: May 4, 2021

(54) FOLDING TAMPER-PROOF CASE AND METHODS THEREOF

(71) Applicant: Citadel Casing Ltd, Tortola (VG)

(72) Inventors: Douglas Rumsam, Hong Kong (CN); Timothée Lesné, Paris (FR); Lewis Cheng, Hong Kong (CN); Andy Wong, Hong Kong (CN)

(73) Assignee: Citadel Casing Ltd, Road Town (VG)

( * ) Notice: Subject to any disclaimer, the term of this patent is extended or adjusted under 35 U.S.C. 154(b) by 0 days.

(21) Appl. No.: 16/904,106

(22) Filed: Jun. 17, 2020

(30) Foreign Application Priority Data

Jun. 4, 2020 (WO) ..... PCT/CN2020/094300

(51) Int. Cl.
*B65D 17/28* (2006.01)
*B65D 5/50* (2006.01)
(Continued)

(52) U.S. Cl.
CPC ..... *B65D 17/401* (2018.01); *B65D 5/4204* (2013.01); *B65D 5/5004* (2013.01); *B65D 5/5019* (2013.01); *B65D 5/5028* (2013.01); *B65D 17/08* (2013.01); *B65D 2401/10* (2020.05)

(58) Field of Classification Search
CPC .. B65D 17/401; B65D 5/4204; B65D 5/5004; B65D 5/5019; B65D 5/5028; B65D 17/08; B65D 2571/0029; B65D 71/16
USPC ..... 229/154, 185; 206/194, 434, 427, 140, 206/156, 196, 589
See application file for complete search history.

(56) References Cited

U.S. PATENT DOCUMENTS 2,373,851 A * 4/1945 Potter ..... B65D 71/004 206/165
2,388,288 A 11/1945 Ringler et al.
(Continued)

FOREIGN PATENT DOCUMENTS

CN 2427446 Y 4/2001
CN 204096216 U 1/2015
(Continued)

OTHER PUBLICATIONS

Partial European Search Report dated Nov. 30, 2020 issued in European Application No. 20184070.9.
(Continued)

*Primary Examiner* — Christopher R Demeree
(74) *Attorney, Agent, or Firm* — Troutman Pepper Hamilton Sanders LLP; Ryan A. Schneider; Christopher C. Close, Jr.

(57) ABSTRACT

The disclosed systems and methods relate to improved tamper-proof cases for securely storing and shipping products. A case can include a back panel, two sidewalls, an upper foldable section, and a lower foldable section. Each of the features of the case can be manufactured on a single sheet of material. The upper and lower foldable sections include panels having apertures for holding the top and bottom of a product, respectively. The upper foldable section includes one or more fasteners that secures the upper foldable section to the sidewalls. Once secured, the products cannot be removed from the case without showing evidence of the removal. The disclosed systems also provide a tear strip and/or a tear corner that can be used to release the products from the sealed case.

20 Claims, 17 Drawing Sheets

(51) Int. Cl.
*B65D 17/00* (2006.01)
*B65D 5/42* (2006.01)

(56) References Cited

U.S. PATENT DOCUMENTS

| | | | | |
|---|---|---|---|---|
| 3,640,380 | A * | 2/1972 | Huffman | B65D 71/0003 206/549 |
| 5,052,552 | A * | 10/1991 | Maroszek | B65D 71/004 206/171 |
| 6,378,697 | B1 | 4/2002 | Sutherland et al. | |
| 6,834,762 | B2 * | 12/2004 | Krisko | B65D 71/0022 206/162 |
| 8,091,702 | B1 * | 1/2012 | Keip | B65D 71/004 206/171 |
| 8,978,889 | B2 * | 3/2015 | Fitzwater | B65D 5/727 206/427 |
| 10,035,623 | B1 * | 7/2018 | Prager | B64D 1/08 |

FOREIGN PATENT DOCUMENTS

| | | | |
|---|---|---|---|
| CN | 105346800 | A | 2/2016 |
| CN | 210213173 | U | 3/2020 |
| DE | 4121566 | A1 | 1/1993 |
| DE | 4219922 | A1 | 3/1993 |
| DE | 29806634 | U1 | 8/1999 |
| FR | 2772347 | A1 | 6/1999 |
| JP | 2003128130 | A | 5/2003 |
| JP | 2014122040 | A | 7/2014 |
| JP | 2016150775 | A | 8/2016 |

OTHER PUBLICATIONS

International Search Report and Written Opinion dated Feb. 25, 2021 issued in Application No. PCT/CN2020/094300.

* cited by examiner

FOLDING TAMPER-PROOF CASE AND METHODS THEREOF

CROSS REFERENCE TO RELATED APPLICATIONS

This application is a continuation of International Application No. PCT/CN2020/094300, having an international filing date of 4 Jun. 2020, which is incorporated herein by reference in its entirety.

TECHNICAL FIELD

Aspects of the present disclosure relate to an improved case or portions thereof for shipping and storing various products, including bottled liquids, and, more particularly, for improving the storage, transport, and protection of products such as beverage bottles.

BACKGROUND

Wine and other beverage producers commonly use rectangular cases made of either wood or cardboard to transport bottles. These cases comprise internal compartments separated by wood, cardboard, plastic, or foam to provide a certain level of protection for the bottles inside. After the bottles are placed within the cases, the cases are closed and set out for shipment to the wholesaler, retailer, or customer. These closed cases of bottles present several problems due to the inherent flaws of the case designs. For example, a wholesaler, retailer, or customer may have difficulties viewing the contents of the case, determining if someone has tampered with the contents of the case, displaying the contents of the case, or any combination of these limitations.

Ordinarily, to view the contents within a bottle case, each individual bottle must be removed from the case. The handling of each bottle creates an opportunity to damage the bottle. Since each bottle in the case can be removed, a fraudster could also tamper with the contents of the bottle case. For example, someone inspecting the bottles can replace a bottle, or the liquid therein, with a different, less-valuable product. Finally, current methods do not provide an aesthetic system for displaying the bottles. The wooden case, for example, requires tools to wedge open the lid, which can be easily damaged when being pried apart from the body of the case. What is needed, therefore, is a system that prevents tampering, provides bottle viewability, and maintains an aesthetic form for displaying the bottles.

SUMMARY

Embodiments of the present disclosure address these concerns as well as other needs that will become apparent upon reading the description below in conjunction with the drawings. Briefly described, aspects of the present disclosure relate to an improved case or portions thereof for shipping and storing various products, including bottled liquids, and, more particularly, for improving the storage, transport, and protection of products such as beverage bottles.

One aspect of the present disclosure provides a tamper-proof case and method of use. The case can be manufactured as a single sheet of material. A plurality of features can be formed into the single sheet, e.g., a flat and coplanar cardboard sheet, such that the case can be folded from an open, flat configuration to a closed configuration for storing bottles or other products.

The case can include a back panel, two sidewalls, an upper foldable section, and a lower foldable section. The upper foldable section and lower foldable section can include several panels foldably connected to one another, for example along a crease or perforation line in the material. The upper foldable section can include a top panel, an upper front panel facing toward the customer, and an upper holder panel, for example. The upper holder panel can include apertures for holding a first end of the product in the case, such as the neck of a bottle. The lower foldable section can include a bottom panel, a lower front panel facing toward the customer, and a lower holder panel, for example. The lower holder panel can include apertures for holding the second end of the product in the case, such as the heel of a bottle.

The case can include a fastener on the upper foldable section. The fastener can include adhesive, tamper-evident tape, and/or another mechanical fastener. An example mechanical fastener described herein includes a foldable tuck-tab fastener. The folding tabs on the tuck-tab fastener can be pinched inwardly and inserted into fastener openings in the sidewalls. Once the fastener is secure, the case can be permanently secured such that the products cannot be removed from the case without the case showing evidence of the removal.

Additional foldable sections or panels are also described herein to increase the structural integrity and security of the case. A top flap and a bottom flap that provide support at the corners of the case are described. The top flap and the bottom flap can abut the back panel and run alongside the sidewalls. The top flap can also include a fastener opening that meets with the fastener opening in the sidewall and accepts the foldable fastener.

The case can also include a tamper-proofing tear strip that enables an end user to remove the contents of the case. The tear strip can be located on the upper holder panel proximate the apertures for holding the first end of the product. Once the tear strip is torn, a portion of the upper aperture can be removed to enable the product to be pulled outwardly from the apertures. The tear strip can also be positioned on the opposite end of the case, such that the tear strip is located proximate the lower apertures holding the second end of the product.

BRIEF DESCRIPTION OF THE FIGURES

Reference now will be made to the accompanying figures, which are not necessarily drawn to scale, and wherein.

DETAILED DESCRIPTION

Figure 1:
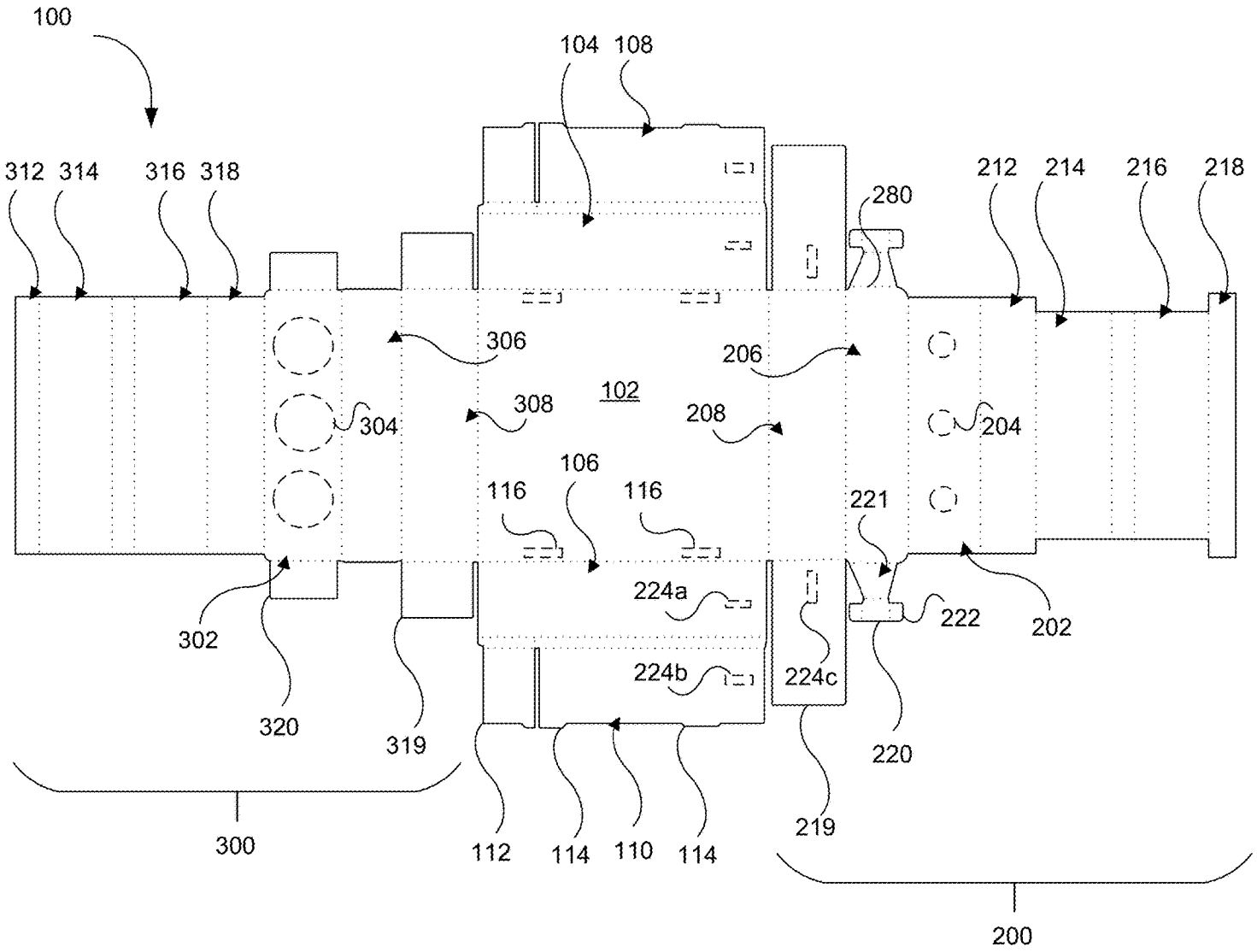
FIG. 1 is a top view of an unfolded case in an open configuration, according to some embodiments of the present disclosure.

The present disclosure can be understood more readily by reference to the following detailed description of exemplary embodiments and the examples included herein. Before the exemplary embodiments of the devices and methods according to the present disclosure are disclosed and described, it is to be understood that embodiments are not limited to those described within this disclosure. Numerous modifications and variations therein will be apparent to those skilled in the art and remain within the scope of the disclosure. It is also to be understood that the terminology used herein is for describing specific embodiments only and is not intended to be limiting. Some embodiments of the disclosed technology will be described more fully hereinafter with reference to the accompanying drawings. This disclosed technology may, however, be embodied in many different forms and should not be construed as limited to the embodiments set forth therein.

In the following description, numerous specific details are set forth. But it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used. Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to and are not intended to imply that the objects so described must be in a given sequence, either temporally, spatially, in ranking, or in any other manner.

Also, in describing the exemplary embodiments, terminology will be resorted to for the sake of clarity. It is intended that each term contemplates its broadest meaning as understood by those skilled in the art and includes all technical equivalents that operate in a similar manner to accomplish a similar purpose.

To facilitate an understanding of the principles and features of the embodiments of the present disclosure, exemplary embodiments are explained hereinafter with reference to their implementation in an illustrative embodiment. Such illustrative embodiments are not, however, intended to be limiting.

The materials described hereinafter as making up the various elements of the embodiments of the present disclosure are intended to be illustrative and not restrictive. Many suitable materials that would perform the same or a similar function as the materials described herein are intended to be embraced within the scope of the example embodiments. Such other materials not described herein can include, but are not limited to, materials that are developed after the time of the development of the disclosed technology, for example.

Reference numbers throughout the figures that are underlined indicate that a particular panel or object is being referred to. For example, an underlined "202" in the figures refers to the panel (e.g., the upper holder panel) being described.

Embodiments of the disclosed technology include a tamper-proof case for storing and transporting bottles of wine. In various embodiments, a tamper-proof case can provide improvements to protecting the integrity of the bottled wine, as well as features that allow a user to more easily use the wine case. A tamper-proof bottle case according to the present disclosure can be used by wine manufacturers to package bottles of wine and also can be used by consumers to store the wine bottles at home or to transport the bottles.

Throughout this disclosure, certain embodiments are described in exemplary fashion in relation to storing and transporting bottles of wine. But embodiments of the disclosed technology are not so limited. In some embodiments, the disclosed techniques may be effective in storing and transporting bottles or containers of many other types of liquids. For example, and not limitation, the upper and lower apertures, as will be described herein, can be configured for spirit bottles, beer bottles, water bottles, cosmetic bottles, and other bottles having different shapes and sizes. It will also be understood that the tamper-proof cases described herein can be configured to store products other than bottles, such as toys, electronics, or any other product.

Figure 2A:
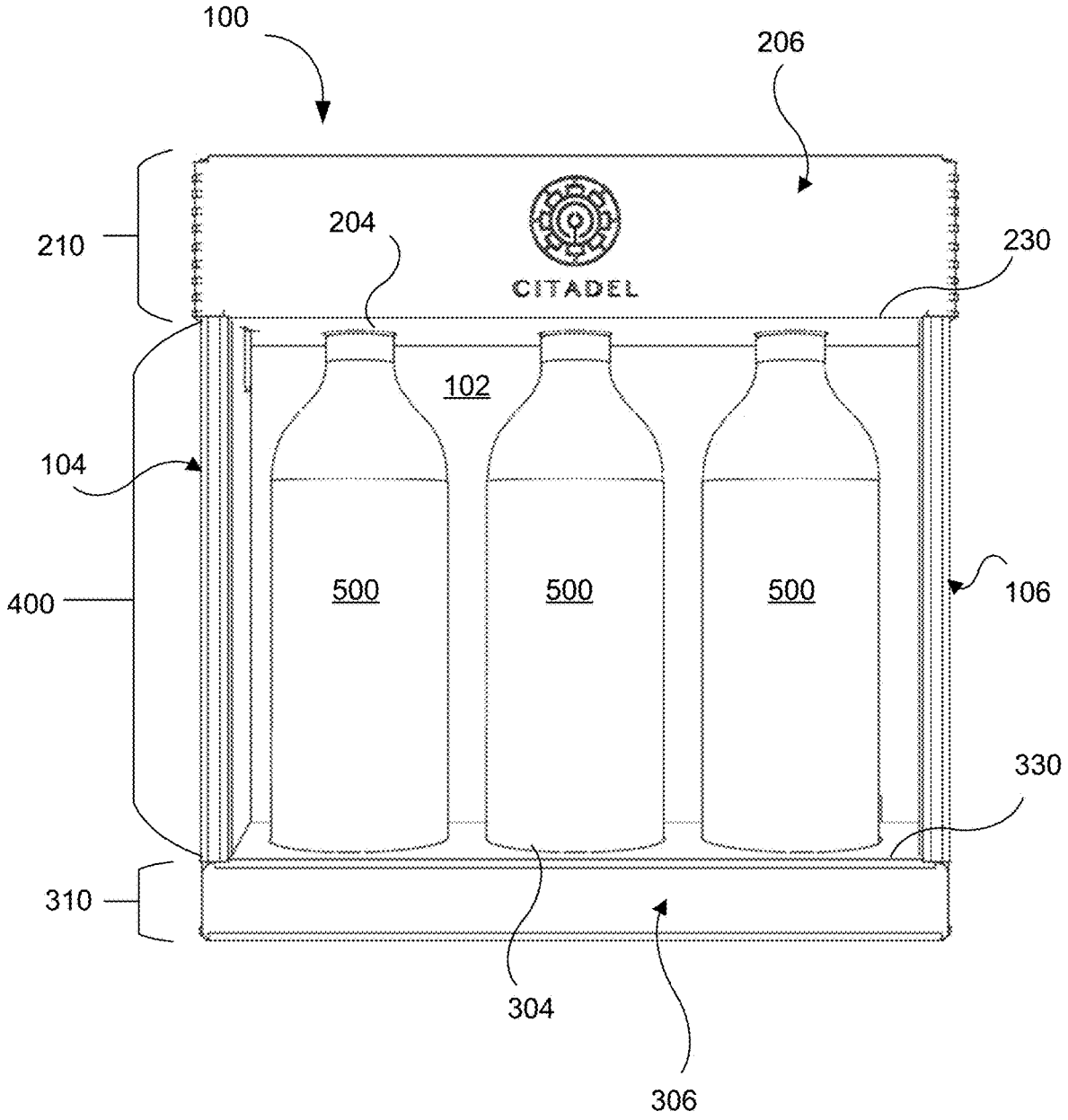
FIG. 2A is a front view of an example case in a closed configuration, according to some embodiments of the present disclosure.

Various devices and methods are disclosed for providing and using a tamper-proof case, and exemplary embodiments of the devices and methods will now be described with reference to the accompanying figures. FIG. 1 is a top view of an unfolded case 100 in an open configuration, according to some embodiments of the present disclosure. As can be seen in the figure, a benefit of the present systems and methods is that a complete case 100 for storing and transporting items can be constructed from a single sheet of material. Referring to FIG. 2A for illustration, the example case 100 is in a closed configuration and is storing bottles 500. In FIG. 2A, each bottle 500 (three bottles in the example) is secured in the closed case. The example shown in FIG. 2A can be folded into this final, closed configuration from a single, coplanar sheet of material similar to the one shown in FIG. 1.

Referring again to FIG. 1, a case 100 can include a back panel 102, a first sidewall 104, a second sidewall 106, an upper foldable section 200, and a lower foldable section 300. When the upper foldable section 200, the lower foldable section 300, the first sidewall 104, and the second sidewall 106 are in their open configurations, as shown in the figure, each feature can be substantially coplanar with the back panel 102. This design provides several benefits. A case 100 can be manufactured, for example, from cutting a single sheet into a desired shape. Additionally, a large quantity of cases 100 can be stacked during shipment to the end user, and the open configuration greatly decreases the storage volume required for empty, open cases 100.

An upper foldable section 200 can include the various features required to store the top of an item, for example the neck of a bottle 500. The upper foldable section 200 can include an upper holder panel 202. The upper holder panel 202 can include one or more upper apertures 204 for holding one end of the items being stored in the case 100. For example, the upper apertures 204 can be sized to hold the neck of a bottle 500. The upper apertures 204 can be cut, stamped, etc. into the upper holder panel 202 to create the hole for holding the bottle 500. The upper aperture 204 can be circular if made to hold a circular neck, for example when storing wine. It is contemplated that the upper aperture 204 can be modified according to the shape of the contents being stored. A spirit bottle can be square, and the upper aperture 204 can be square; an electronic device or a toy can have any number of geometries, and the upper apertures 204 can be formed to hold those geometries. Using a bottle as an example, the dimensions of the upper aperture 204 can also be modified based on the dimensions of the particular bottle being stored in the case 100, since bottles can take many different shapes and sizes (e.g., piccolo or split (187.5 ml), demi or half (375 ml), standard (750 ml), magnum (1.5 L), double magnum (3.0 L), etc.).

The upper holder panel 202 can be foldably connected to an upper front panel 206. The upper holder panel 202 and the upper front panel 206 are separated by a dotted line in the figure; dotted lines are used in FIG. 1 to indicate where a fold can be made. The use of the term "foldably" herein can be understood to mean that two features are connected but that one can be moved, or hinged, with respect to the other. This movement can be facilitated by providing an area in the material of the case 100 that is creased, perforated, and/or the like. Furthermore, the various "panels" herein can be described with reference to their location or purpose on the case 100 when the case 100 is in a closed configuration. An upper front panel 206, for example, is the panel that, once the case 100 is closed, is facing the front of the case 100; the upper holder panel 202 is facing toward the product within the case 100 (e.g., the bottle) to hold the item when the case 100 is closed. Referring to FIG. 2A for illustration, the upper front panel 206 is at the top of the closed case 100. A "top" panel can be on the top of the case 100 in FIG. 2A; similar is true for the lower front panel, bottom panel, and lower holder panel, which will be described in greater detail herein.

Referring again to FIG. 1, the upper front panel 206 can be foldably connected to a top panel 208. Again, once the upper foldable section 200 is in a closed configuration, the top panel 208 can form the top of the closed case 100. The top panel 208 can be foldably connected to the back panel 102. Once the upper holder panel 202, upper front panel 206, and top panel 208 are in a closed configuration, the three panels can form a box to hold and conceal the top of the bottle 500. Referring to FIG. 2A for illustration, the top of the case 100 comprises an upper box 210 that holds the neck of the bottle 500. The entirety of the upper box 210 can be created, for example, by folding the upper holder panel 202 inwardly to 90° with respect to the upper front panel 206 (i.e., perpendicular), folding the upper front panel 206 inwardly to 90° with respect to the top panel 208, and folding the top panel 208 inwardly 90° with respect to the back panel 102. This final folding step will cause the upper holder panel 202 to rest 90° with respect to the back panel 102.

The upper foldable section 200 can also include additional panels to increase the amount of material at the top and thus increase the protection of the bottles and the rigidity of the case 100. These panels, referred to as top internal supports 212,214,216,218, can extend beyond and be foldably connected to the upper holder panel 202. When the upper foldable section 200 is in a closed configuration, the top internal supports 212,214,216,218 can be found inside the upper box 210 formed by the upper holder panel 202, the upper front panel 206, and the top panel 208. An upper box 210 with a plurality of top internal supports 212,214,216,218 can protect the bottles 500 within the case 100 and ensure they do not break. For example, a case 100 with a plurality of top internal supports 212,214,216,218 can be dropped at the top corner of the case 100 from a distance of about 0.9 m without damaging the bottles therein. This is a significant improvement over legacy cases, as many cases use dry pulp to cover the bottles 500 to protect them. The present system can provide the protection without the addition of unattractive, bulky padding like dry pulp.

The upper foldable section 200 can include one or more top flaps 219 extending from the top panel 208. The top flap 219 can be folded inwardly prior to folding the upper foldable section 200 into its closed configuration. One edge of the top flap 219 can rest, or abut, the back panel 102. The one or more top flaps 219 can provide additional structural support for the corners of the case 100 where the sidewalls 104,106 meet with the upper foldable section 200. The top flap 219 can prevent the case 100 from opening at those corners and also provide compression support if dropped on the corner.

The first sidewall 104 and the second sidewall 106 can be folded inwardly to approximately 90° with respect to the back panel 102, thereby forming the sides of the case 100. The first sidewall 104 and second sidewall 106 can include a first sidewall flap 108 and a second sidewall flap 110, respectively. The first sidewall 104 and second sidewall 106 can be folded inwardly to provide additional side support for the case 100. In example cases 100 with one or more top flaps 219 (or bottom flaps 319), the first sidewall flap 108 and/or second sidewall flap 110 can fold over the top flaps 219, thereby sandwiching the top flaps 219 between respective sidewalls 104,106 and sidewall flaps 108,110. This construction can also provide additional rigidity at the top corners of the case 100.

The first sidewall flap 108 and/or the second sidewall flap 110 can include one or more locking tabs 114 extending therefrom. The locking tab 114 can be an extension of the sidewall flap 108,110 that can extend into a respective tab slit 116 in the back panel 102. For example, once the sidewall flaps 108,110 are folded to the back panel 102, a locking tab 114 can extend into a tab slit 116 to prevent the sidewall flaps 108,110 from separating from the sidewalls 104,106 (for example like opening a book).

A lower foldable section 300 can include the various features required to store the bottom of an item, for example the heel of a bottle 500. The lower foldable section 300 can include a lower holder panel 302. The lower holder panel 302 can be similar to the upper holder panel 202 except that the lower holder panel 302 can include one or more lower apertures 304 for holding the second end of the product, e.g., the heel of the bottle 500. The lower apertures 304 can be sized according to the shape and dimensions of the product being stored.

The lower holder panel 302 can be foldably connected to a lower front panel 306. The lower front panel 306 can be foldably connected to a bottom panel 308. Once the lower foldable section 300 is in a closed configuration, the bottom panel 308 can form the bottom of the closed case 100. The bottom panel 308 can be foldably connected to the back panel 102. Once the lower holder panel 302, lower front panel 306, and bottom panel 308 are in a closed configuration, the three panels can form a box to hold and conceal the bottom of the product. Referring to FIG. 2A for illustration, the bottom of the case 100 comprises a lower box 310 that holds the bottom of the product. The lower box 310 can be similar to the upper box 210. By folding the lower foldable section 300 similar to the upper foldable section 200, the lower holder panel 302 can rest 90° with respect to the back panel 102.

Similar to the upper foldable section 200, the lower foldable section 300 can also include additional panels to increase the amount of material at the bottom and thus increase the protection to the bottles and the rigidity of the case 100. These panels, referred to as bottom internal supports 312,314,316,318 can extend beyond and be foldably connected to the lower holder panel 302. The bottom internal supports 312,314,316,318 can be similar in all regards to the top internal supports 212,214,216,218 to provide drop protection at the bottom corners of the case 100.

The lower foldable section 300 can include one or more bottom flaps 319 extending from the bottom panel 308. The bottom flap 319 can be folded inwardly prior to folding the lower foldable section 300 into its closed configuration. One edge of the bottom flap 319 can rest, or abut, the back panel 102. The one or more bottom flaps 319 can provide additional structural support for the corners of the case 100 where the sidewalls 104,106 meet with the lower foldable section 300. The one or more bottom flaps 319 can be similar to the top flaps 219 of the upper foldable section 200. A sidewall flap 108,110 can be folded onto the lower holder flaps 320 in a final closed configuration. In other examples, the case 100 can include one or more base flaps 112 that can be folded over the bottom flaps 319 once the bottom flaps 319 are abutting the back panel 102.

The lower foldable section 300 can also include one or more lower holder flaps 320 extending from the lower holder panel 302. The lower holder flaps 320 can be folded such that, when the lower foldable section 300 is in a closed configuration, the lower holder flaps 320 are directed toward the upper foldable section 200. One edge of the lower holder flaps 320 can rest, or abut, the back panel 102. The lower holder flaps 320 can add additional structural support for the case and/or provide padding for the heel of a bottle 500. In some examples, a sidewall flap 108,110 can be folded onto the lower holder flaps 320 in a final closed configuration.

In some examples, the upper foldable section 200 can include a fastener 220 to permanently lock the case 100 when bottles 500 or other products are stored within the case 100. In FIG. 2A, for example, the upper front panel 206 and the lower front panel 306 are both in a closed configuration and are coplanar with one another. In this closed configuration, some example cases 100 enable the products to be stored such that they cannot be removed from the case 100 without evidence of such removal. As described above, legacy storage systems did not provide evidence of such tampering—a bottle 500 or other product could be removed from the case and the contents of the bottle 500 could be altered. In the case of wine bottles, this is a significant limitation, as someone can easily remove an expensive bottle and replace it with a less valuable bottle or, alternatively, someone can consume the contents of the bottle and replace the liquid with less valuable wine. The present systems for storing bottles solves this problem by providing a fastener 220 to permanently secure the bottles 500 or other products within the case 100. Throughout this disclosure, reference to "permanent storage" or "permanent attachment" can be understood to mean that the products cannot be removed and replaced without showing evidence of this tampering. The fastener 220 can be positioned on a fastener tab 221 that folds around the sidewalls 104,106 when the case 100 is in a closed configuration.

The fastener 220 can include any attachment that can secure the case 100 into a closed configuration. This can include but is not limited to adhesive, tamper-evident tape, and/or a mechanical fastener. Tamper-evident tape can include any tape known in the art that can be used to indicate whether the tape has been removed, broken, or cut. For example, tamper-evident tape can include wording that prohibits the tape from being realigned and reattached once removed. Tamper-evident tape can include language similar to "check contents if seal is broken" and the like. The tape can also include labels that evidence the opening of the case 100 if broken or torn.

A number of mechanical fasteners can also be used to permanently secure the case 100. Referring again to FIG. 1, a fastener 220 can include a tuck tab as shown in the figure. The tuck-tab fastener 220 includes one or more folding tabs 222 that can be pinched inward and inserted into a fastener opening (e.g., a slit or hole, as shown in the example as fastener opening 224*a,b,c*). Once inside the fastener opening 224*a,b,c*, the one or more folding tabs 222 can expand to lock the fastener 220 into place. FIGS. 4I-4M show the steps of using an example tuck-tab fastener 220 to secure a case 100. In some examples, the fastener opening can be disposed on the sidewalls 104,106 (e.g., fastener opening 224*a*). When a case 100 includes a sidewall flap 108,110, the sidewall flap 108,110 can include a fastener opening (e.g., fastener opening 224*b*) that meets with the first fastener opening 224*a* once the sidewall flap 108,110 is folded inward. When a case 100 includes one or more top flaps 219, the one or more top flaps 219 can include a fastener opening (e.g., fastener opening 224*c*) that meets with the first fastener opening 224*a* and/or second fastener opening 224*b* once the top flap 219 is folded inward. The inclusion of multiple fastener openings 224*a,b,c* can increase the stability and strength of the case 100 when a fastener 220 is inserted into each of the fastener openings 224*a,b,c*.

Another mechanical fastener 220 can include a tab extending from the fastener tab 221 that includes shaped card, which is shaped like an arrow that can pass in only one direction through a fastener opening 224*a,b,c*. In other examples, the mechanical fastener 220 can include securing a tab extending from the upper front panel 206 to the sidewalls 104,106 with a stapleless staple technique. The stapleless staple technique punctures a first portion of the material being stapled, folds that first portion over on top of the non-punctured portion of the material, and then tucks the first portion under a slit to hold the material (or multiple layers of material) together. Other mechanical fasteners are contemplated, including but not limited to rivets, staples, and the like.

The material for the single-piece case 100 can include cardboard, corrugated cardboard, greyboard, paper, fiber pulp (including paper pulp) and/or the like or any combinations thereof. As described above, the several panels described herein can be foldably connected to any adjacent panel. To this end, the material can be sufficiently flexible to enable the folding of the panels. It is also contemplated that the various panels can be a more rigid material, such as wood and the like, and each panel can be foldably attached via a hinge. An example hinge can include a fabric hinge and/or a metal hinge, including but not limited to a butt hinge, a case hinge, a bi-fold hinge, a piano hinge, and the like.

The case 100 can also be manufactured from fiber that includes natural biomass materials. It is also contemplated that the materials used for a bottle case 100 can take advantage of the raw resources found at the bottling facilities. For example, wine bottlers may have an excess of biomass byproduct created from the winemaking process. This biomass byproduct can include vine clippings, leftover grape seeds, and leftover grape skins. A spirit bottler may, for example, have leftover barley, rye, sugarcane, or other fermentation byproducts. Therefore, it is contemplated the bottle case 100 may take advantage of this excess biomass. In some embodiments, the recycled cardboard can include waste from the liquid manufacturing processes, including but not limited to vine clippings, grape seeds, grape skins, barley, rye, and/or sugarcane. The percentage of natural biomass that is included into the fiber product can be 20% or more of the recycled product, e.g., vine waste. The case 100 can also include synthetic polymers, e.g., plastics, and/or a combination of synthetic polymers and natural materials. Any of the materials described can also include recycled materials.

FIG. 2A is a front view of an example case 100, according to some embodiments of the present disclosure. The example case 100 is shown storing three bottles, which is in accordance with the present disclosure. However, the case 100 is not limited to three bottles 500. For example, the case can be modified to include any bottle shape or quantity, including one bottle or any larger quantity.

The case 100 can be manufactured such that, once the bottles 500 are inserted into the case 100 and the panels are all in their closed configuration, the bottles 500 therein can be separated (i.e., raised) from the back panel 102 a certain distance. In other words, the bottles 500 can be suspended and supported only by the upper apertures 204 and lower apertures 304. The distance of separation between the bottle 500 and the back panel 102 can depend on the bottle 500 being stored. For example, a heavier bottle (e.g., double magnum (3 L)) may require more separation than a single bottle (0.75 L). If the case 100 impacts the ground, considering inertia for example, a larger bottle may move more in the upper apertures 204 and/or lower apertures 304 than a smaller bottle. As a non-limiting example, the bottles 500 can be separated from the back panel 102 by a distance of about 0.5 cm to about 1.5 cm.

In a fully closed configuration, as shown in FIG. 2A, the upper front panel 206 and lower front panel 306 (both facing toward the customer) can define an observation window 400. For example, a bottom edge 230 of the upper front panel 206 can define the top of an observation window 400, and a top edge 330 of the lower front panel 306 can define the bottom of the observation window 400. The observation window 400 enables a view of the bottle 500 without removing the bottle 500 from the case 100. As described above, previous systems for storing and transporting bottles included wood or ordinary cardboard cases. To view the bottles 500 within these previous designs, the bottles 500 had to be removed from the case. The present design enables customers and industry stakeholders to quickly and easily access and read labels on the bottle 500, ensure the contents are correct, and apply additional labels to the bottle 500 if necessary. This can solve the issue of bottlenecks in the supply chain by speeding up the quality control inspection process while also dramatically improving the customer experience.

The dimensions of an observation window 400 can be customized based on the size of the one or more bottles 500 being stored in the case 100. The bottom edge 230 can be designed such that the upper front panel 206 does not obscure a view of the level of the liquid within the bottle 500. Consider, for example, a bottle 500 comprising wine. The bottom edge 230 can be positioned such that the upper front panel 206 does not extend over the top level of the wine. This can enable a customer to view the bottle to make sure that no liquid has been removed from the bottle 500. In some examples, the bottom edge 230 can extend from about 3.0 cm to about 6.0 cm from the top of the bottle 500. When the upper foldable section 200 includes top internal supports 212,214,216,218 forming the upper box 210, the distance from the bottom edge 230 to the top panel 208 can be greater, for example from about 3.0 cm to about 8.0 cm. Similarly, it is contemplated that the top edge 330 of the lower front panel 306 does not obscure bottle labels. In some examples, the top edge 330 can extend from about 2.0 cm to about 5.0 cm from the bottom of the bottle 500. When the lower foldable section 300 includes bottom internal supports 312,314,316,318 forming the lower box 310, the distance from the top edge 330 to the bottom panel 308 can be greater, for example from about 2.0 cm to about 8.0 cm. The upper front panel 206 and the lower front panel 306 also have the additional benefit of providing a surface branding on the case 100. For example, an example height of from about 4.0 cm to about 8.0 cm can provide a large flat surface for brand labels.

In some examples, the case 100 can include a lid, not shown in FIG. 2A, that slides over the entirety of the case 100 to conceal the contents therein. This enables the present case 100 design to also serve as the shipping container for the bottles 500. In some examples, the case 100 can be inserted into an exterior box or container for shipment.

Figure 2B:
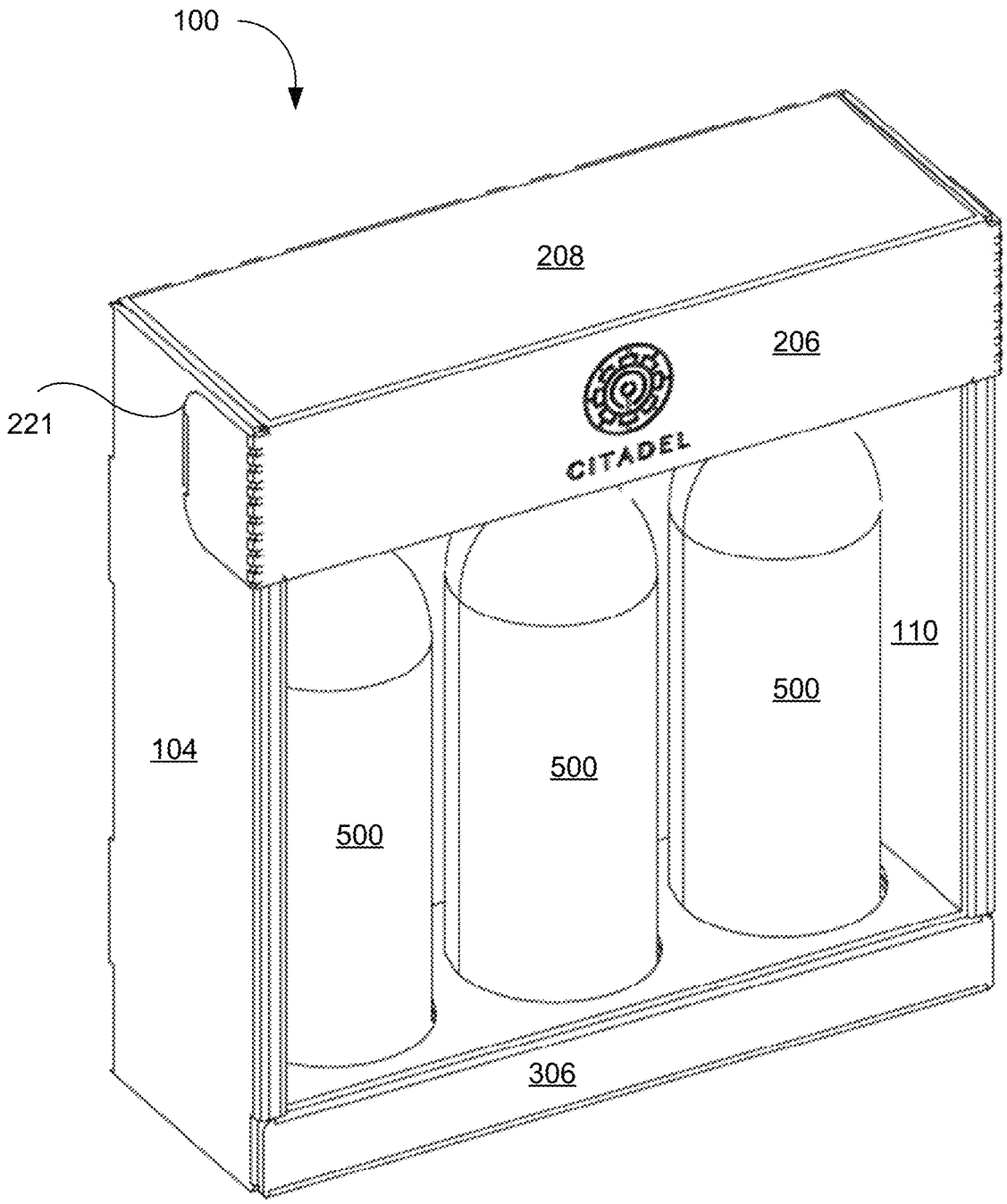
FIG. 2B is a perspective view of an example case in a closed configuration, according to some embodiments of the present disclosure.

As described above, once the case 100 is in a closed configuration and storing bottles 500 or other products, the case 100 can be permanently sealed. This can mean that, in order to remove any bottle 500 in the case, the material of the case 100 may be torn or destroyed—thus evidencing the tampering of the case. In some examples, the case 100 can include features to help facilitate the removal of the bottles 500. For example, the upper box 210 and/or lower box 310 can include features that help the customer open the permanently sealed case 100. These features can include, but are not limited to, perforation lines (e.g., tear corner 280), tear strips (e.g., tear strip 256), and/or the like or any combination thereof. FIG. 2B is a perspective view of the example case 100 shown in FIG. 2A.

Figure 3A:
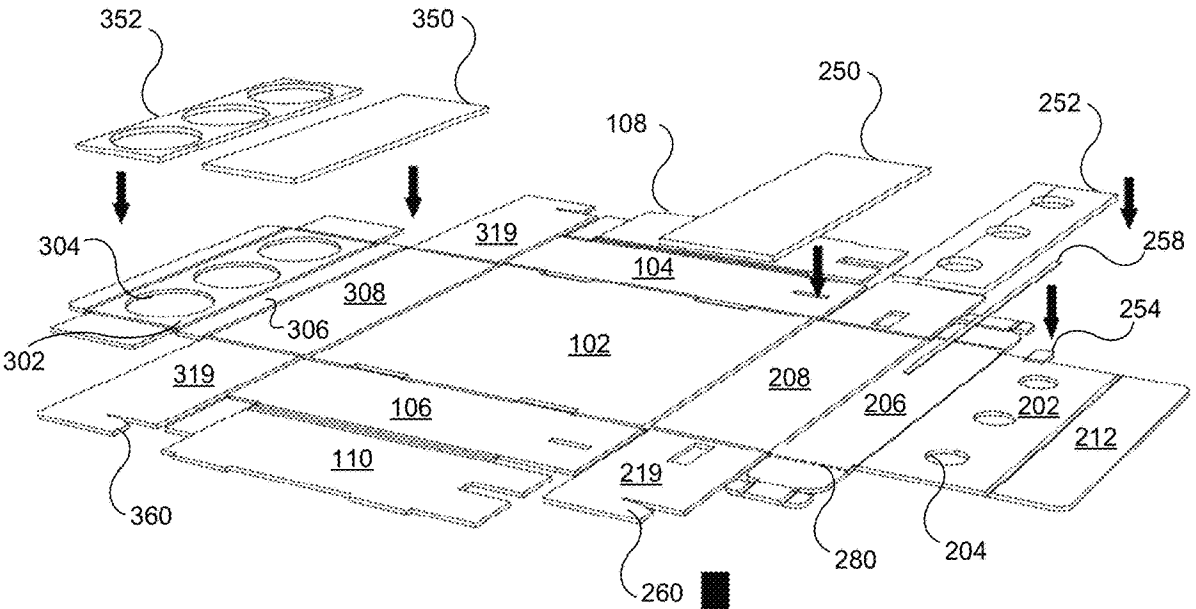
FIGS. 3A and 3B are perspective views of a case in an open configuration, according to some embodiments of the present disclosure.
Figure 3B:
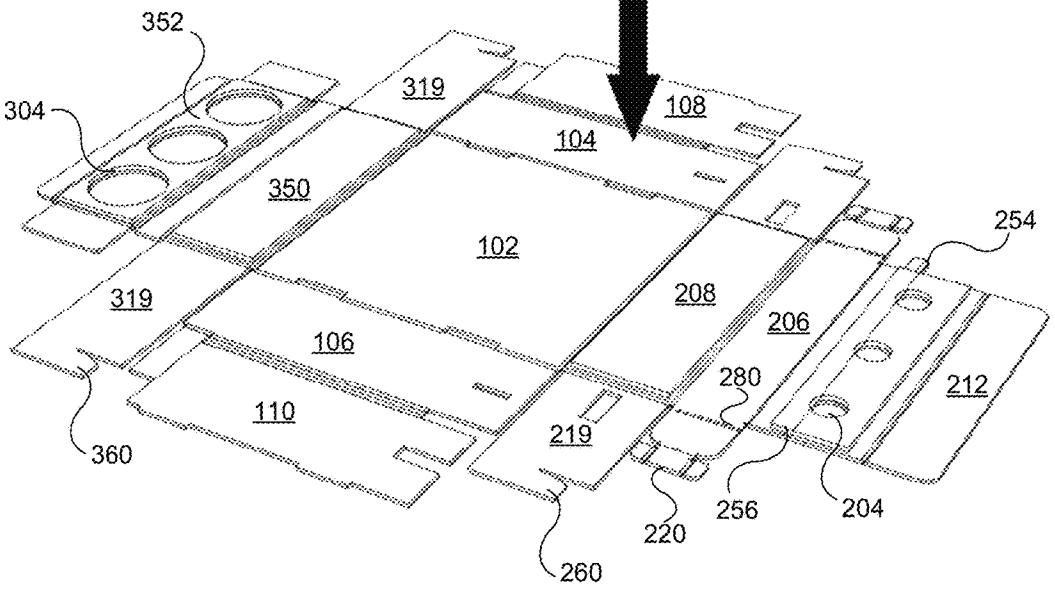

FIGS. 3A and 3B are perspective views of a case in an open configuration, according to some embodiments of the present disclosure. The two figures show example reinforcement features that can be used within a case 100 to further increase its stability and integrity. As described above, an aim of the present disclosure is to provide sturdy packaging to protect the product in the case 100, even if the case 100 is dropped, for example from above 0.9 m. Certain locations on the case 100 where the products are supported can include additional padding. For example, the case 100 can include lower pad 350 and/or an upper pad 250. The lower pad 350 and/or lower pad 250 can be a layer of material, which can be the same material as the case 100 or a different material, that increases the thickness of the case 100 at the bottom panel 308 and top panel 208, respectively. The case 100 can include a lower aperture pad 352 and/or an upper aperture pad 252 to protect the part of the case 100 around the lower apertures 304 and upper apertures 204, respectively. This padding, which also can be the same material or a different material than the case, can provide additional support directly around the product in the apertures 204,304. Any panel of the case can include additional padding. The additional padding can be secured to the case 100 using adhesive, double-sided tape, and similar attachment mechanisms. FIG. 3A is a partially exploded view wherein the padding is elevated from the case 100; FIG. 3B shows the padding attached to the case 100. It has been shown that a case 100 manufactured according to the examples shown in FIGS. 3A and 3B is able to be dropped from 0.9 m without breaking bottles stored within the case 100. In addition, it has been shown that a case 100 manufactured according to the examples shown in FIGS. 3A and 3B can withstand a 10-drop sequence, one drop for each of 10 orientations, without breaking bottles stored within the case 100. These orientations included: the most fragile corner; the shortest edge radiating from the drop corner; the medium edge radiating from the drop corner; the longest edge radiating from the drop corner; a flat surface of the case on the smallest face; a flat surface opposite smallest face of the case; a flat surface on one of the medium faces; a flat surface opposite the medium face of the case; a flat surface on the largest face of the case; and a flat surface on the opposite large face of the case. The case according to the examples shown in FIGS. 3A and 3B is configured to pass various recognized drop tests such as, for example, the ISTA 1A drop test.

In some examples, the top flap(s) 219 and the bottom flap(s) 319 can include hooks that enable the two features to hook together when in the closed configuration. For example, a top hook 260 on the first top flap 219 can meet with a bottom hook 360 on the bottom flap 319 when the flaps 219,319 are folded inwardly in the closed configuration. These hooks 260,360 can enable the flaps 219,319 to engage and increase the integrity of the sides of the case 100. This hooking mechanism can be seen in detail in FIG. 4C.

In some examples, the case 100 can include a tear tab 254 to help facilitate the removal of the products within the case 100 when the case 100 is in a closed configuration. As described above, once the case 100 is closed, it can be permanently sealed around the products, e.g., bottles. A mechanism to remove the products from the case 100 includes a tear tab 254 that can be pulled to remove a tear strip 256 located on one of the upper holder panel 202 or the lower holder panel 302. Referring to the case 100 in FIG. 3B for illustration, the tear strip 256 can be a portion of the upper holder panel 202 that can be torn from the case 100 to open (or remove) a portion of the upper apertures 204. The tear strip 256 can be a strip defined by perforations in the surface of the case 100. In other examples, the tear strip 256 can include a strip of material 258 that helps remove a portion of the panel. For example, the strip of material 258 can be disposed on the surface of the panel or inside the layers of the panel. The strip of material 258 can be attached to or end at the tear tab 254. When the tear tab 254 is pulled, the strip of material 258 tears along the tear strip 256 to remove the portion of the upper holder panel 202 or the lower holder panel 302.

To further facilitate the release of the bottles or other products from the closed case 100, the junction between the upper front panel 206 and the fastener tab 221 can include a tear corner 280. The tear corner 280 can include perforations or other tear lines that enable the upper front panel 206 to separate (or hinge) with respect to the upper front panel 206. This tearing and hinging of the upper front panel 206 can facilitate the removal of the upper part of the product (e.g., neck of the bottle) from an upper aperture 204. The tear tab 254, tear strip 256, and tear corner 280 are discussed in greater detail below with reference to FIGS. 5A-5E.

FIGS. 4A-4M depict an example process of packaging a bottle 500 within an example case 100, according to some embodiments of the present disclosure. The process shown in FIGS. 4A-4M is merely exemplary and is illustrative of a possible boxing/packaging process. Some example cases may include more, less, or different features than the case 100 shown in FIGS. 4A-4M. Additionally, and as described throughout this disclosure, the cases 100 described herein can store and secure products other than bottles.

Figure 4A:
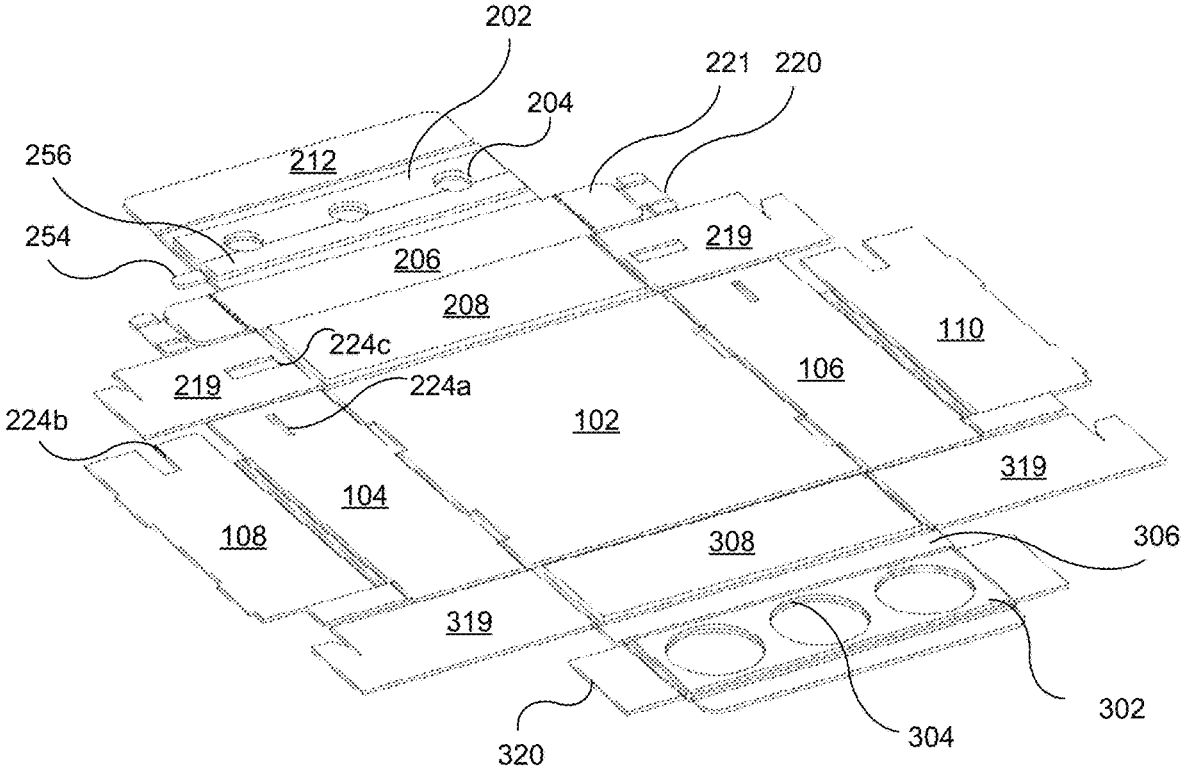
FIGS. 4A-4M depict an example process of packaging a bottle within an example case 100, according to some embodiments of the present disclosure.
Figure 4B:
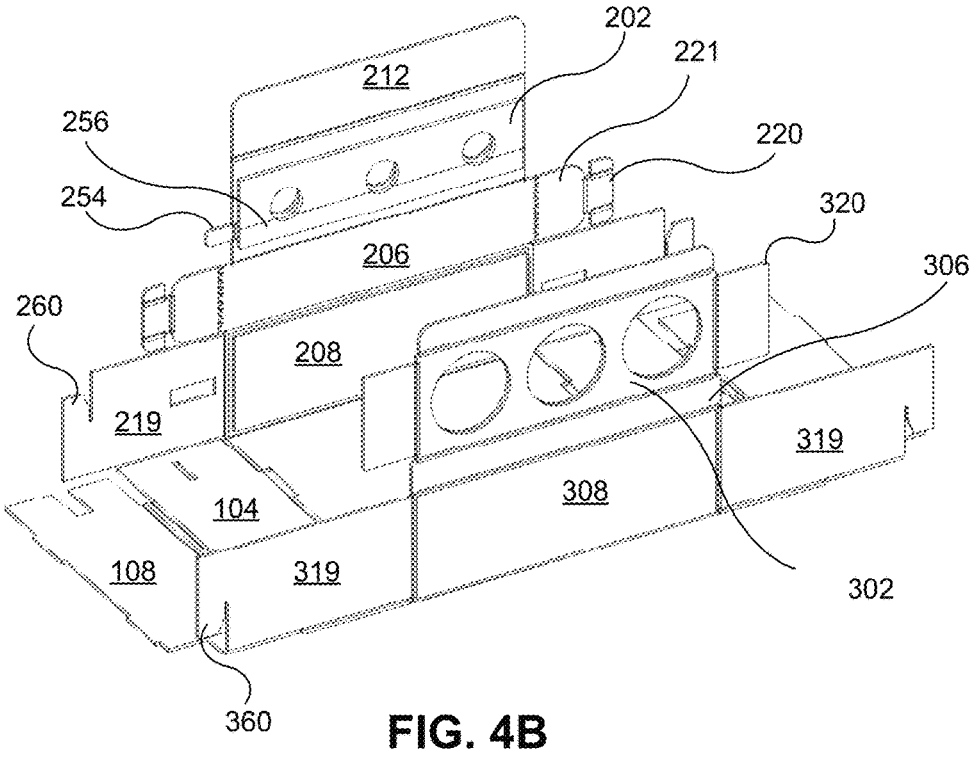

In FIG. 4A, the example case 100 is provided in an open configuration, wherein the entirety of the packaging is flat, and all of the respective foldable panels are coplanar. As described above, the case 100 can include padding features at various panels (e.g., lower pad(s) 350, upper pad(s) 250, upper aperture pad(s) 252, lower aperture pad(s) 352, etc.). In FIG. 4B, the upper foldable section 200 (i.e., top panel 208, upper front panel 206, upper holder panel 202, and a top internal support 212) is folded inwardly and toward the back panel 102, and the lower foldable section 300 (i.e., bottom panel 308, lower front panel 306, lower holder panel 302) is folded inwardly and toward the back panel 102.

Figure 4C:
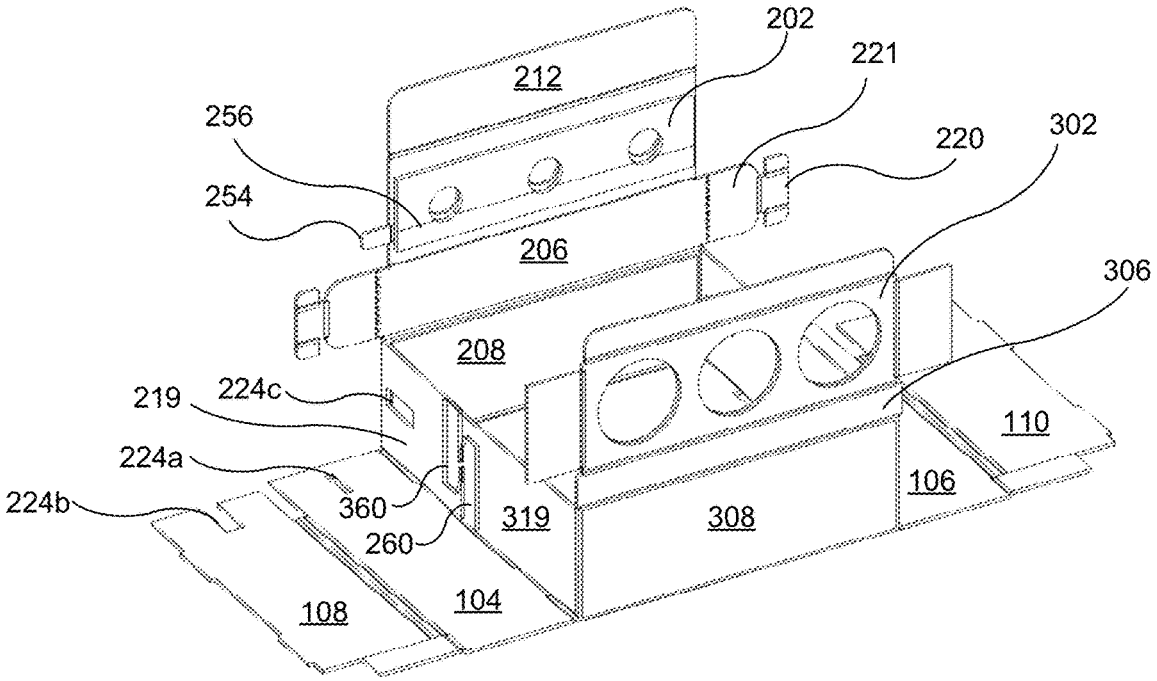

In FIG. 4C, the top flaps 219 and bottom flaps 319 are folded inwardly to create sides of the case 100. As described above, the top flap(s) 219 can include a top hook 260 that engages with a bottom hook 360 on the bottom flap(s) 319. Engaging the top hook 260 and the bottom hook 360 can create a study wall along the side of the case 100, formed by the top flaps 219 and bottom flaps 319.

Figure 4D:
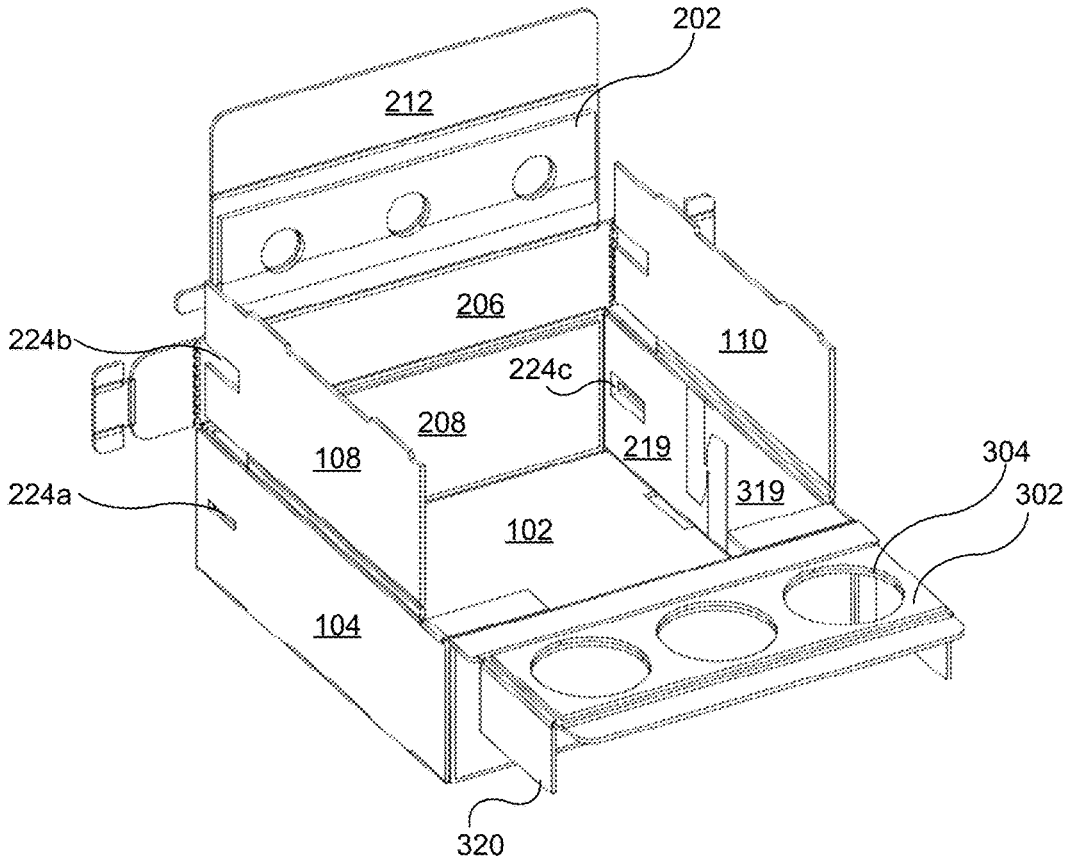

In FIG. 4D, the sidewalls 104,106 and sidewall flaps 108,110 are folded inwardly and perpendicular to the back panel 102. The lower holder panel 302 can also be folded outwardly, and away from the internal cavity of the case 100. The lower holder flaps 320 can be folded outwardly. Once the sidewalls 104,106 are folded inwardly, they will abut and rest adjacent to the top flaps 219 and bottom flaps 319. Fastener openings 224*a* on the sidewalls 104,106 can now align with the fastener openings 224*c* on the top flaps 219.

Figure 4E:
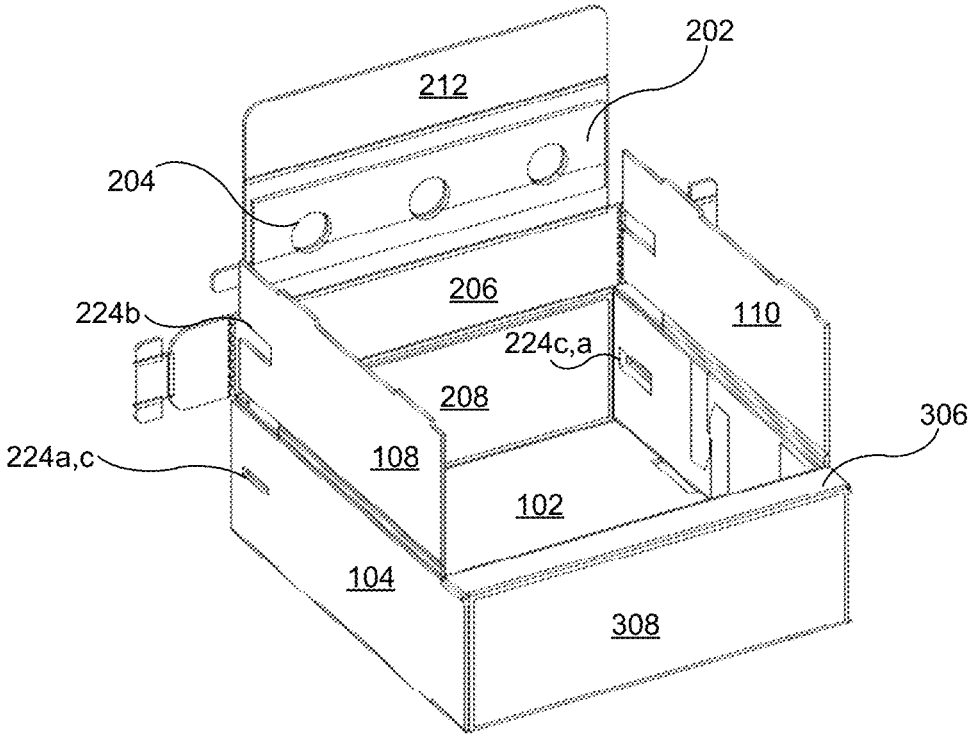

In FIG. 4E, the lower holder panel 302 and lower holder flaps 320 are folded inside of the cavity formed by the sidewalls 104,106, bottom panel 308, and top panel 208. This folding can create the platform to accept and hold the bottom of the product (e.g., the heel of the bottle).

Figure 4F:
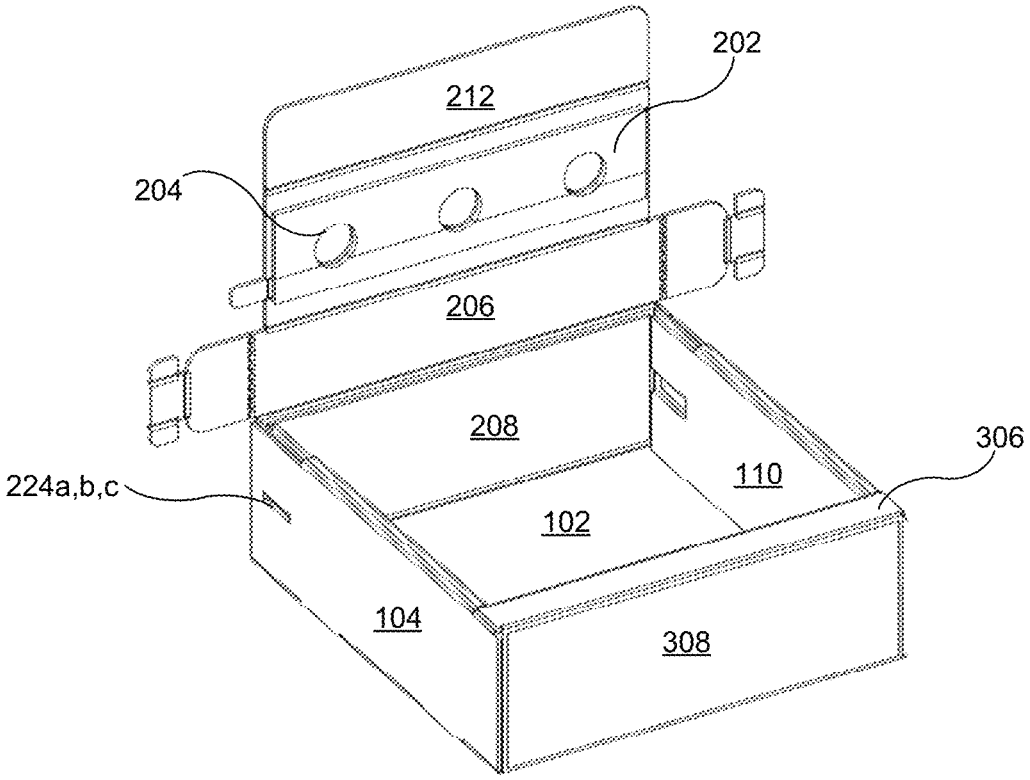

In FIG. 4F, the sidewall flaps 108,110 are folded inwardly and over the top flaps 219 and bottom flaps 319, thereby concealing the top flaps 219 and bottom flaps 319 between the sidewalls 104,106 and sidewall flaps 108,110 (and protecting the hooks 260,360 if included in the case 100). At this step, the fastener openings 224*b* on the sidewall flaps 108,110 can align with the already aligned fastener openings 224*a,c*, thereby creating a three-layer fastener opening 224*a, b,c*.

Figure 4G:
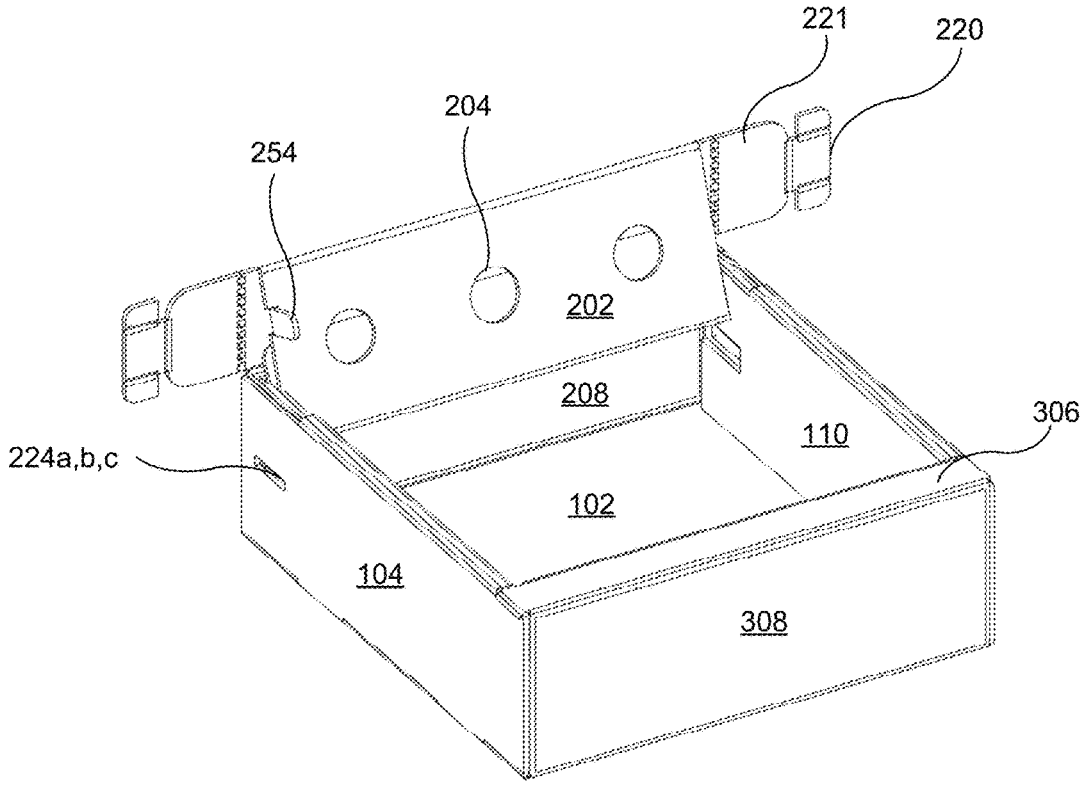
Figure 4H:
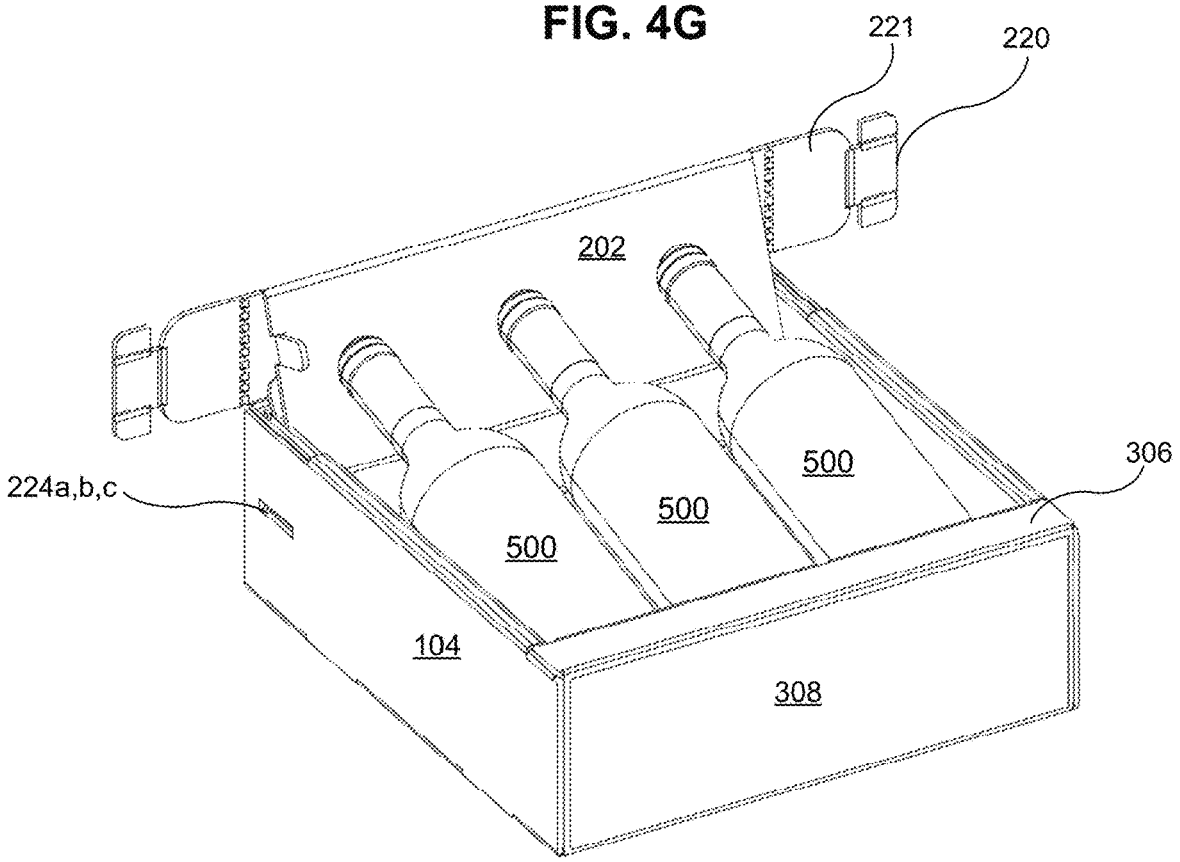

In FIG. 4G, the top internal support 212 and upper holder panel 202 are folded inwardly and toward the back panel 102. Folding the upper holder panel 202 inwardly can position the upper apertures 204 toward the bottom panel 308. In FIG. 4H, the bottom of a product (e.g., heel of a bottle 500) can be positioned in the lower apertures 304, and the top of the product (e.g., neck of the bottle 500) can be placed within the upper apertures 204. Once the top of the product is inserted into the upper aperture 204, the product can be fully seated and the upper foldable section 200 can be moved into its closed configuration. From the position where the top of the product is inserted into the upper aperture 204 to the position where the product is fully seated, the top of the product can drop from about 1.0 cm to about 3.0 cm toward the back panel 102.

Figure 4I:
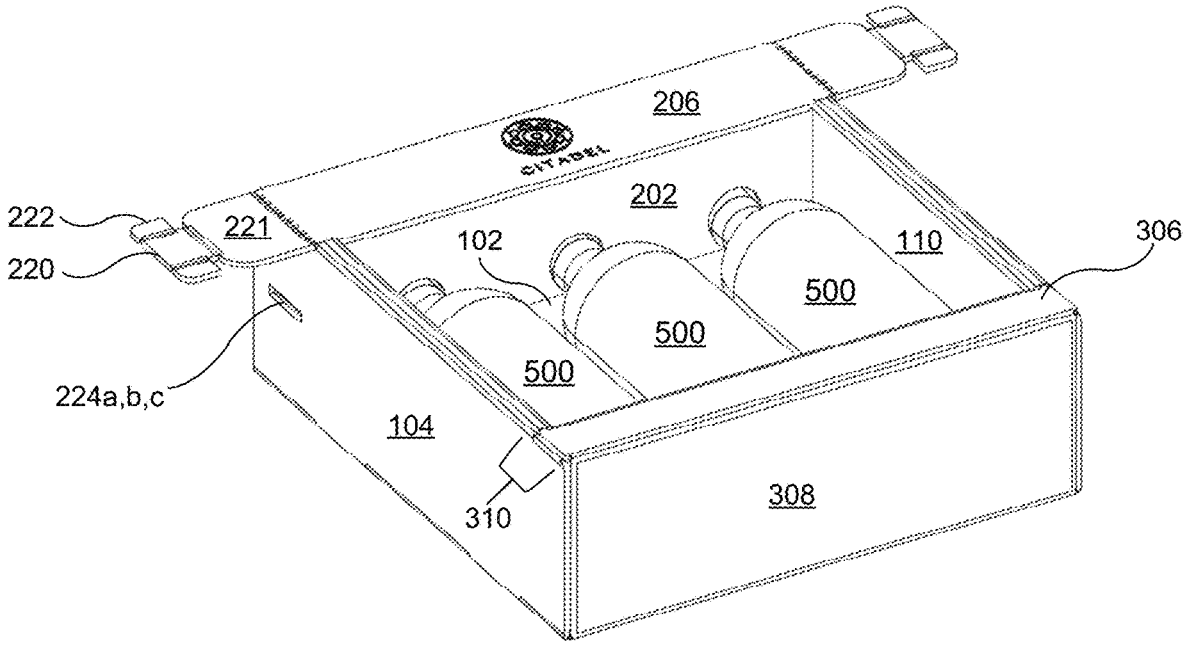

In FIG. 4I, the bottle 500 is fully seated and the upper holder panel 202 can abut the back panel 102. At this point, the fastener openings 224*a,b,c* are only visible on the outside of the case 100 (e.g., on the sidewalls 104,106). On the inside of the case 100, the fastener openings 224*a,b,c* can be concealed by the upper box 210 created by the upper holder panel 202, the top panel 208, and the back panel 102. This design can help prevent tampering with the case 100 when the fasteners 220 are fully locked into the fastener openings 224*a,b,c*. The example fastener 220 in FIGS. 4A-4M is a tuck-tab fastener 200. The tuck-tab fastener 220 includes two folding tabs 222 that can be pinched inward and inserted into a fastener openings 224*a,b,c*.

Figure 4J:
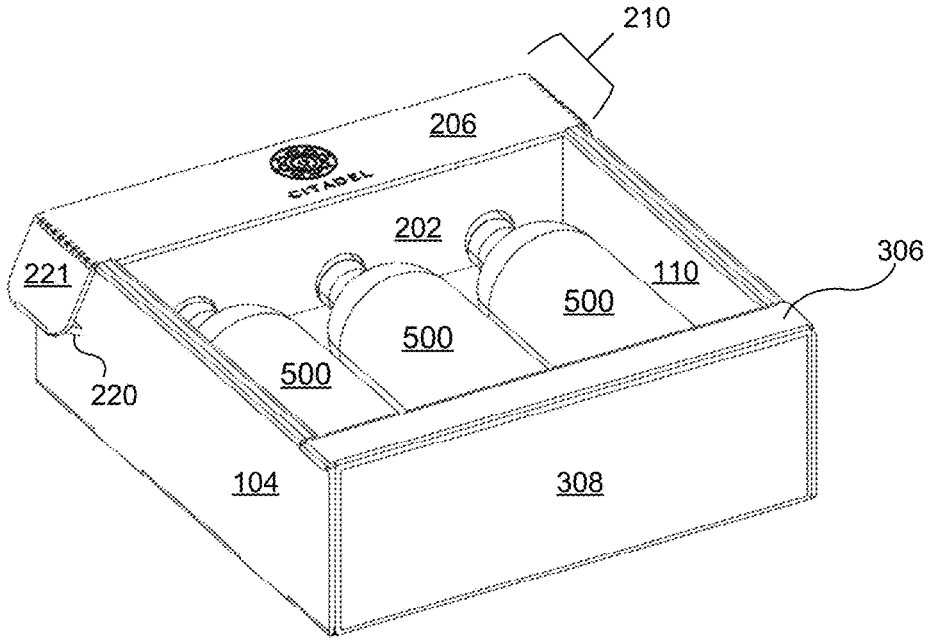
Figure 4K:
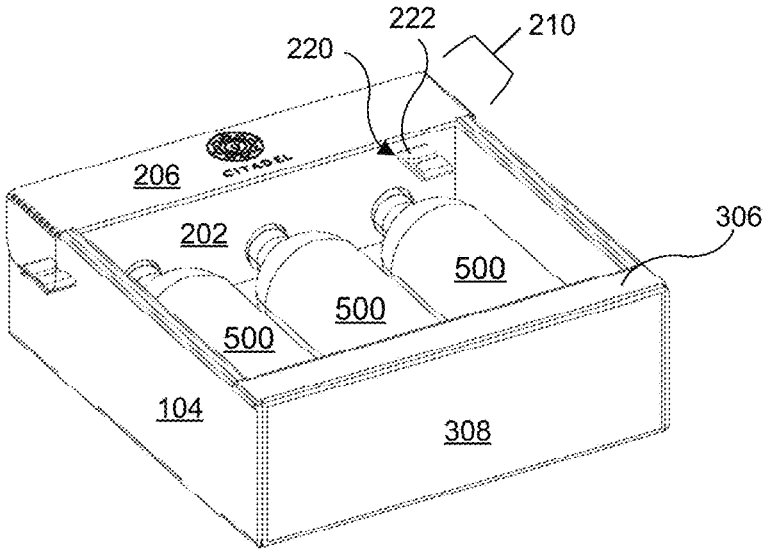
Figure 4L:
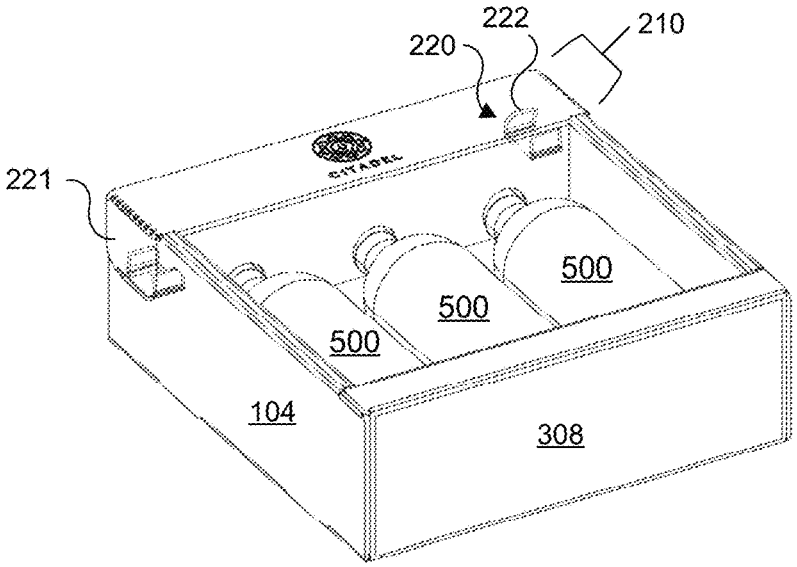
Figure 4M:
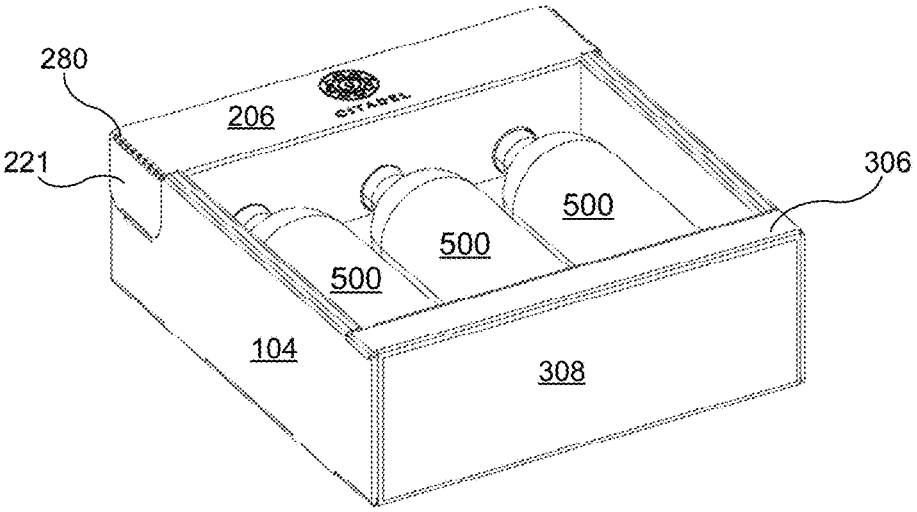

In FIG. 4J, the folding tabs 222 of the fastener 220 are pinched inwardly, and the pinched folding tabs 222 are inserted into the fastener openings 224*a,b,c*. FIGS. 4K and 4L are partial-cutaway views such that the folding tabs 222 are visible within the upper box 210. In FIG. 4K, the folding tabs 222 unfold, thereby locking the fastener tab 221 in place and permanently securing the products into the closed case 100. FIG. 4M shows the end result, wherein the fastener tab 221 is secured. In some examples, the corner defined by the fastener tab 221 folded with respect to the upper front panel 206 can be a tearable corner (e.g., the tear corner 280 described above) to facilitate opening the case 100. This opening is described below with reference to FIGS. 5A-5E.

Figure 5A:
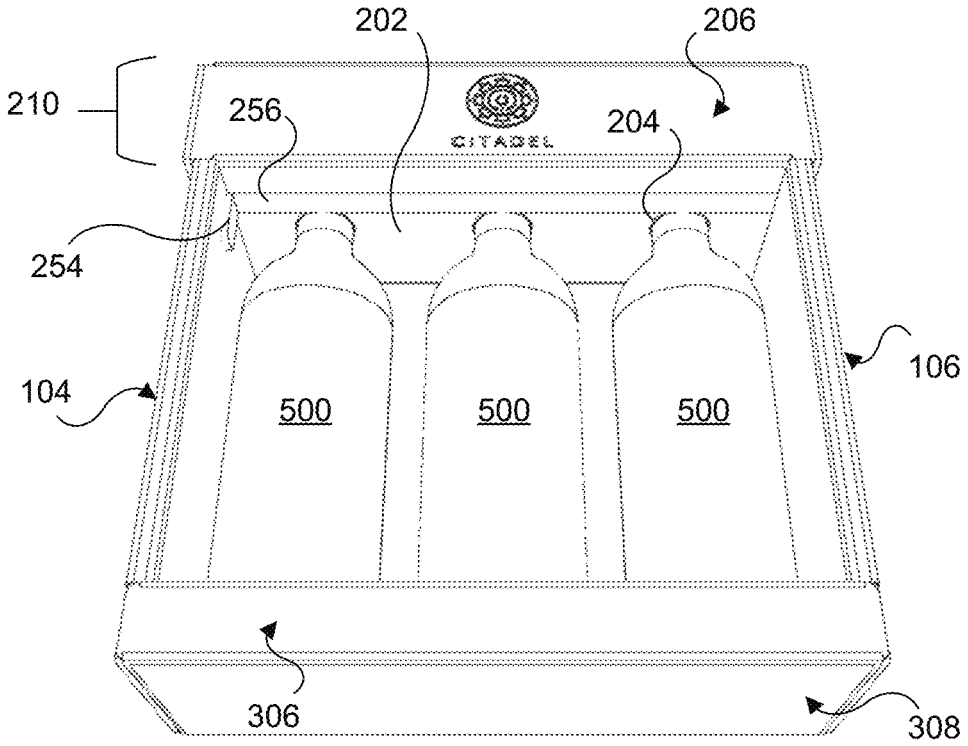
FIGS. 5A-5H depict example steps and mechanisms to release a product from a closed case, according to some embodiments of the present disclosure.

FIGS. 5A-5E depict example steps to release a product from a closed case 100, according to some embodiments of the present disclosure. In FIG. 5A, the products (bottles 500 in this example) are fully sealed into the case 100. The example case 100 includes a tear tab 254 and a tear strip 256 on the upper holder panel 202. The tear strip 256 is positioned such that at least a portion of the perimeter of the upper apertures 204 is defined by the tear strip 256. This can help facilitate the removal of the first end of the product from the case 100.

Figure 5B:
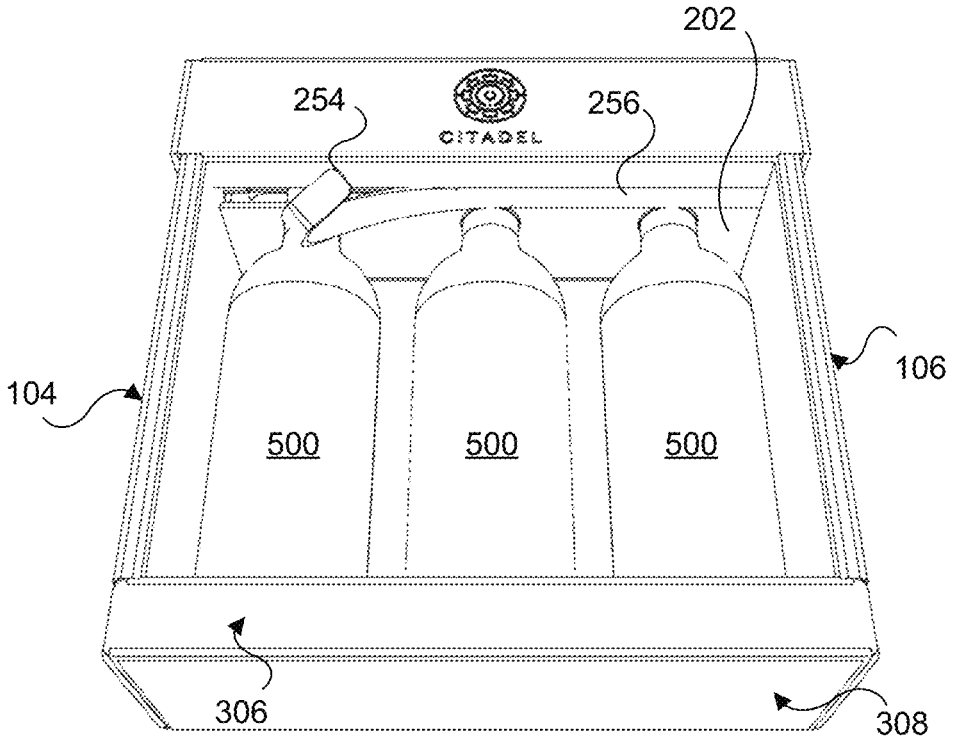

In FIG. 5B, the tab 254 is pulled, thereby pulling the tear strip 256 from the upper holder panel 202. As described above, the tear strip 256 can be defined by a perforation line on the upper holder panel 202 and/or can include a secondary material (such as an internal piece of plastic, fabric, etc.) that assists in tearing the upper holder panel 202.

Figure 5C:
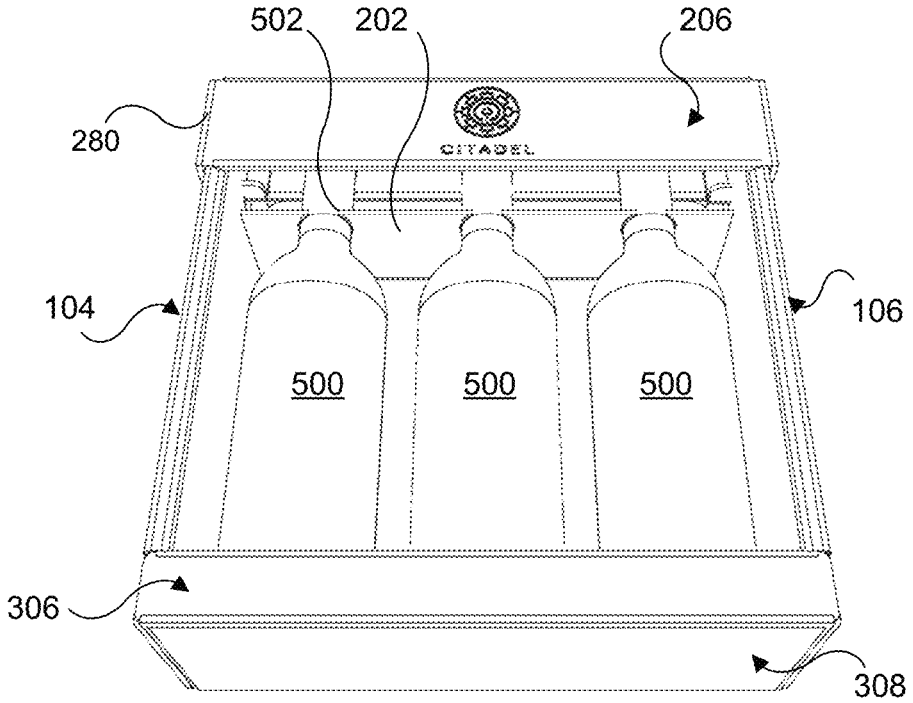

In FIG. 5C, the tear strip 256 is completely removed. Removing the tear strip 256 can create an opening 502 in the upper apertures 204 (e.g., the portion of the perimeter that is defined by the tear strip 256) to remove the product. In some examples, the corner defined by the fastener tab 221 folded with respect to the upper front panel 206 can be a tearable corner (e.g., the tear corner 280) that facilitates opening of the upper front panel 206. The tear corner 280 can be a perforation line disposed between the fastener tab 221 and the upper front panel 206. The tear corner 280 can be a perforation line to assist in opening the case 100 at the upper front panel 206. The perforation line can evidence tampering and prohibit fraudulent repair, and a variety of designs for perforation lines may be used for this purpose. Simple perforation holes, or slotted perforation holes, can be used to create the tearable corner 280. In other examples, the tearable corner 280 can include other designs to alert the consumer of possible tampering. For example, some designs can create a wider, more jagged edge once torn. An example perforation line can include a series of alternating crescents, or half circles. If the alternating crescents are torn, the resulting tear will be a curving line that is difficult to repair. Another example perforation line can include a series of alternating wishbone shapes. If the alternating wishbone shapes are torn, the resulting tear line will include a series of knobs remaining from the wishbone shapes. These knobs may, again, be difficult to repair without showing significant damage to the perforation line. Another example perforation line can include a series of alternating caret shapes. If the alternating caret shapes are torn, the resulting saw-tooth tear line would be difficult to repair and hide the tampering. The above perforation shapes are merely exemplary and are not intended to be limiting. An additional perforation line shape for the tearable corner 280, for example, is discussed in greater detail below with reference to FIG. 5H.

Figure 5D:
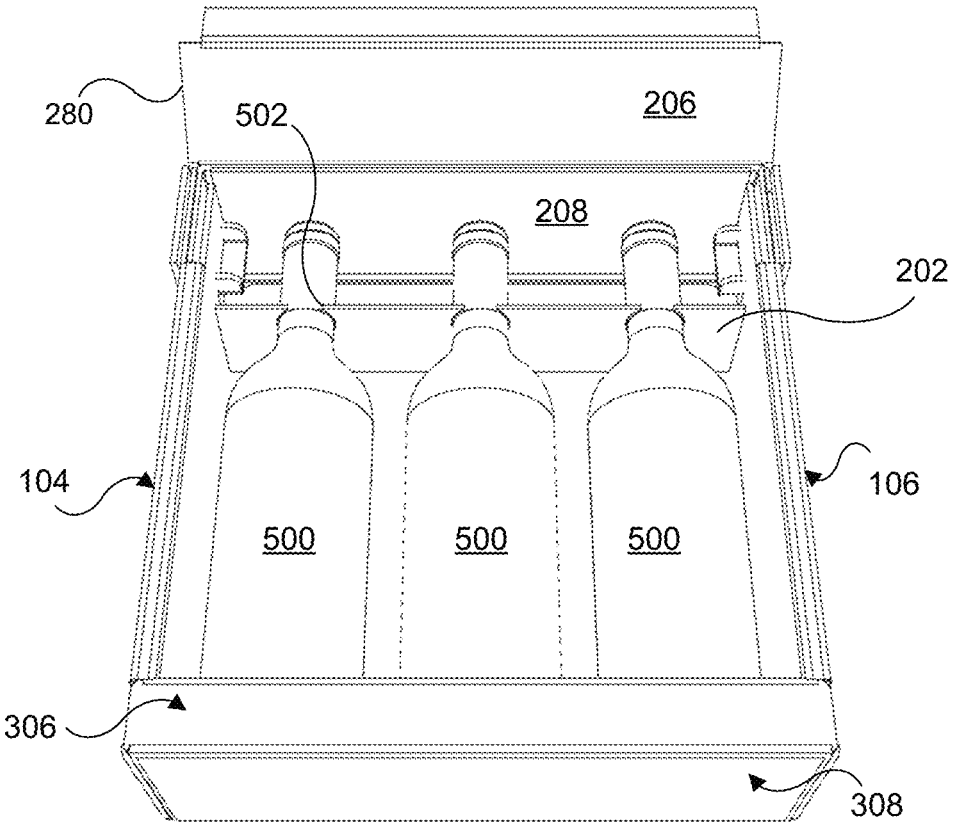
Figure 5E:
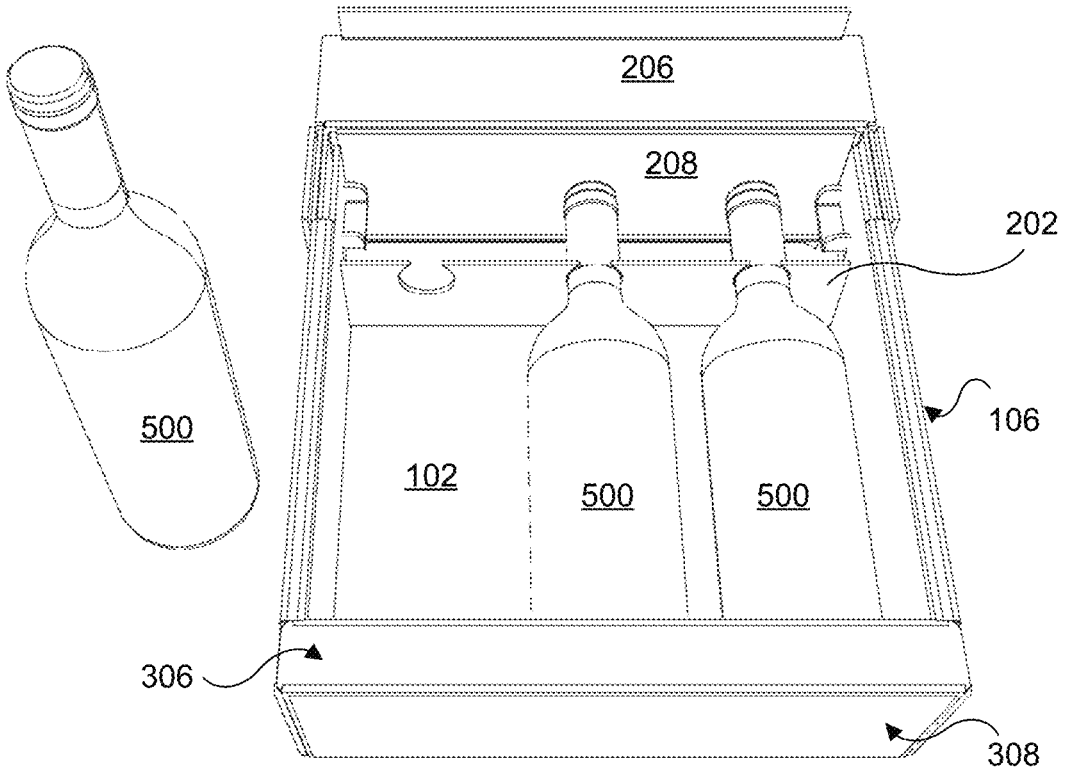

In FIG. 5D, the tear corner 280 is torn, and the upper front panel 206 is hinged up, thereby uncovering the top portion of the product in the case 100. At this point, top of the product can be pulled outwardly from the opening 502 (and from the opened upper box 210) and removed from the case 100, as seen in FIG. 5E.

Figure 5F:
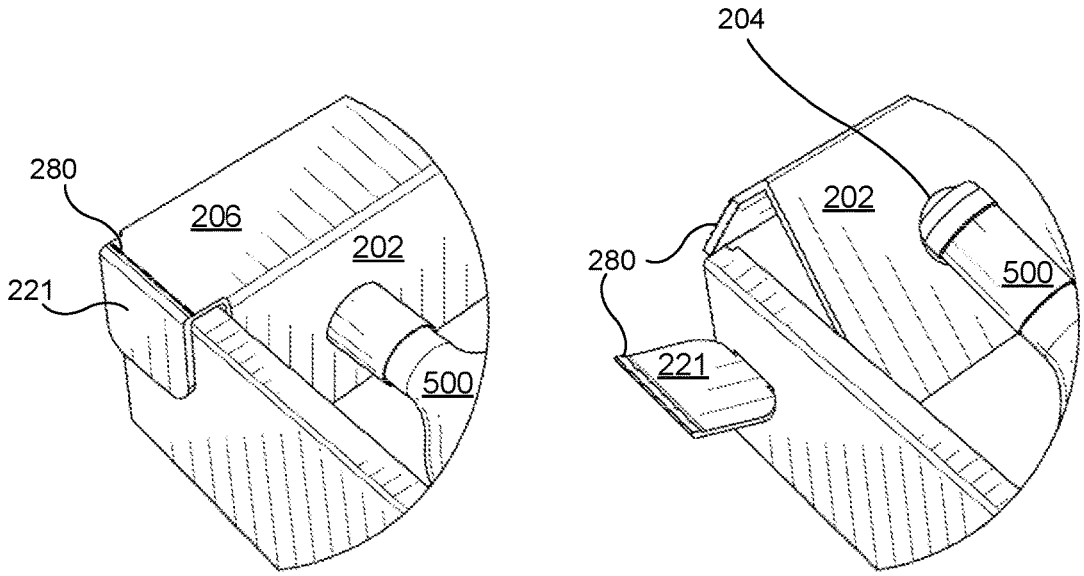
Figure 5G:
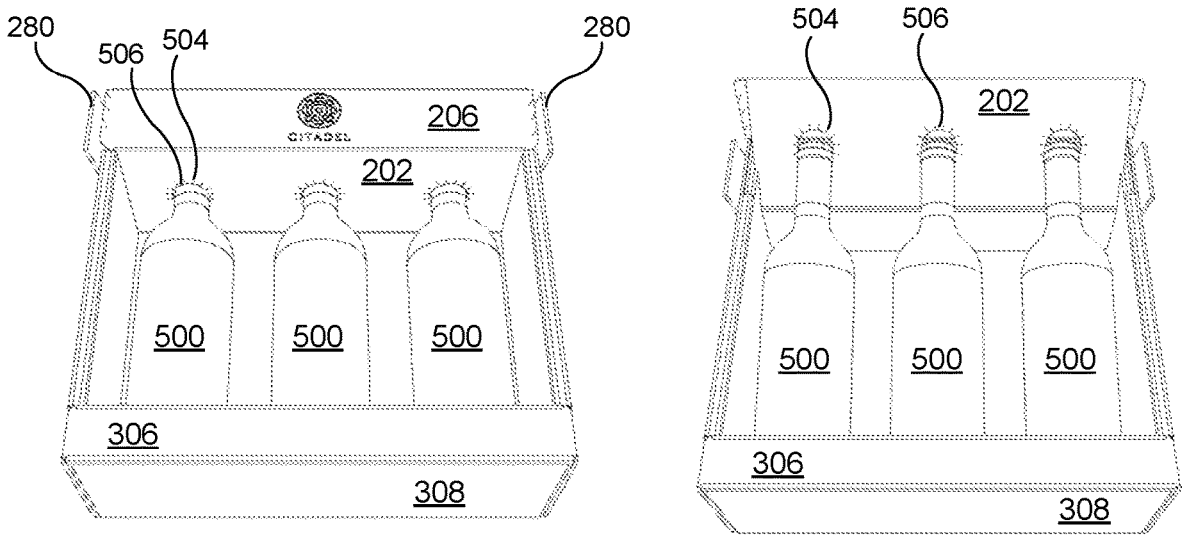

The tear corner(s) 280 can be provided along with the tear strip 256 to enable opening the upper front panel 206. In other examples, the case 100 can include only the tear corner(s) 280 and not include a tear strip 256. In these cases, the upper front panel 206 can be pushed upwards to break the tear corner(s) 280. This can enable the upper holder panel 202 to hinge upwards, and the upper part of the product (e.g., the neck of the bottle 500) can be removed from the upper apertures 204. FIGS. 5F and 5G provide an illustration of this example. In FIG. 5F, the upper holder panel 202 does not include a tear strip 256. The bottles 500 can be removed by tearing the tear corner(s) 280 (e.g., by lifting the upper holder panel 202 and/or by pushing the upper front panel 206 inward) and hinging the upper front panel 206 upward, thereby providing clearance for the upper part of the bottle 500 to be pulled from the upper apertures 204. As the upper front panel 206 moves upwards, the upper holder panel 202 can flatten with respect to the upper front panel 206. As the upper holder panel 202 flattens and the upper front panel 206 moves upwards, the neck(s) of the bottle(s) 500 move diagonally upwards and out of the case 100. When more than one bottle 500 is stored in the case 100, the neck of each bottle 500 can raise simultaneously, providing an aesthetic presentation as the case 100 is opened. This aesthetic presentation of the bottles 500 being lifted from the case 100 is shown in FIG. 5G. When the tear corner(s) 280 are broken, example cases can provide audible feedback of such tearing. This audible feedback of the tear corner(s) 280 breaking can also notify an end user than someone is opening, or attempting to open, the case 100.

It will be understood that, although FIGS. 5A-5G show a case 100 wherein the locking features (e.g., fastener 220, fastener tab 221, and/or tear corner(s) 280) are placed at the top of the case 100 near the upper holder panel 202, it will be understood that the locking features can be positioned on the bottom of the case 100 near the lower holder panel 202. The only changes to the design to accommodate this embodiment include moving the features to the opposite end of the case. The products can, in these examples, be removed by removing the bottom of the product from the case 100 and then pulling the product downwardly out of the case 100.

Referring again to FIG. 5G, in some examples, the upper apertures 204 and/or lower apertures 304 can include slits 504 cut into the periphery of the apertures. The slits 504 can define a plurality of aperture fingers 506 for holding the product. The aperture fingers 506 can enable the apertures 204,304 to accommodate products (e.g., bottles) of varying sizes. As the product is enclosed within the case 100 (for example as shown in FIG. 4H), the aperture fingers 506 can deflect to accommodate larger products. This feature can be beneficial for storing bottles of wine, as different wine varietals may require differently shaped bottles, even if the bottles hold the same volume of liquid. The aperture fingers 506 can enable the differently-shaped bottles to be used within the same case 100.

Figure 5H:
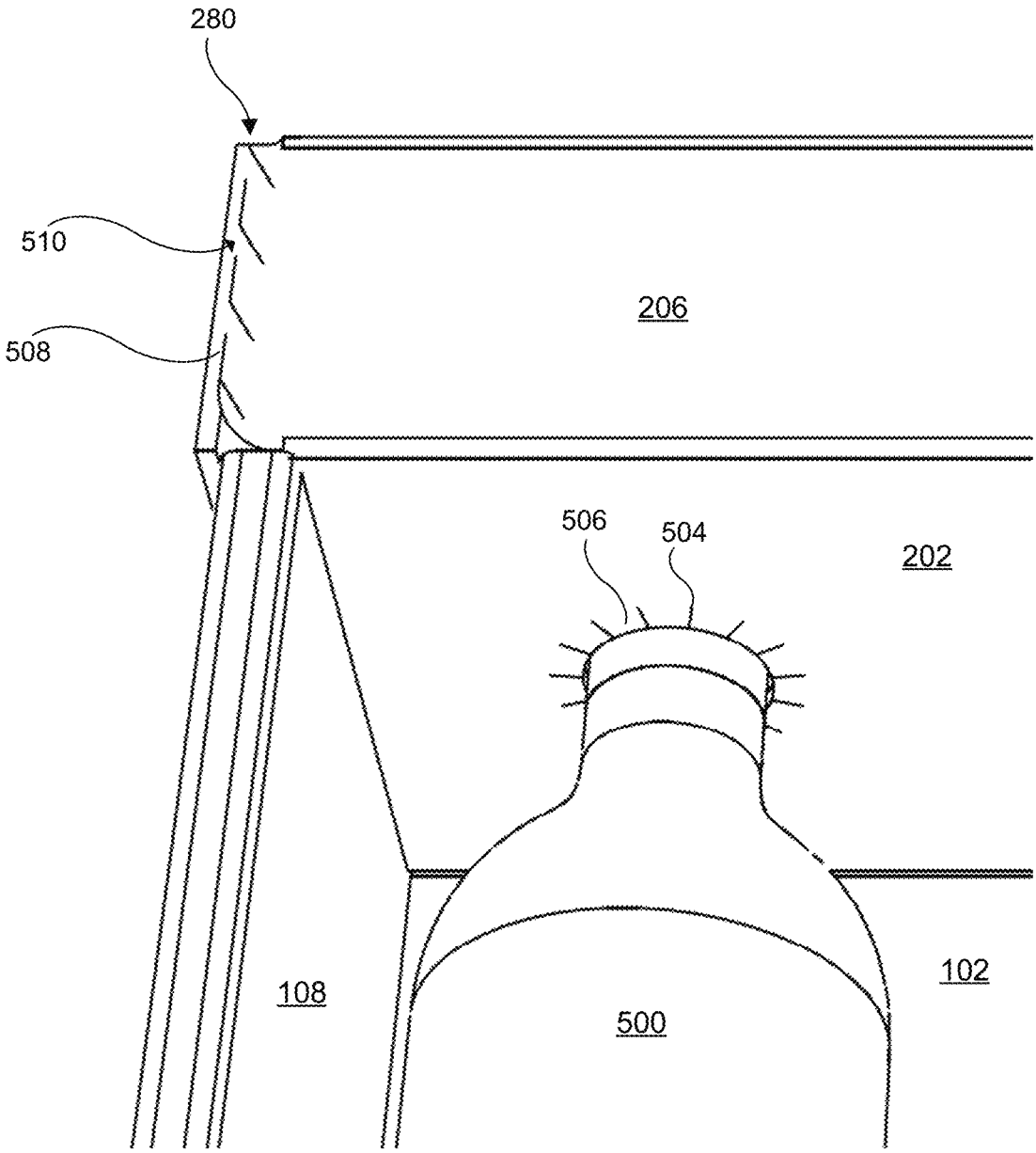
Figure 6B:
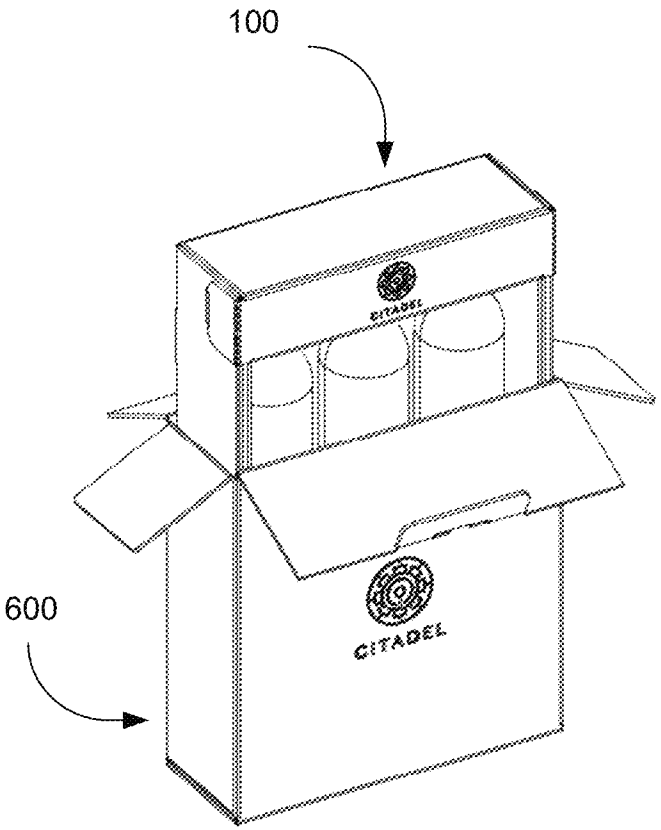
FIGS. 6A-6D are perspective views of a case being positioned within an outer box, according to some embodiments of the present disclosure.
Figure 6A:
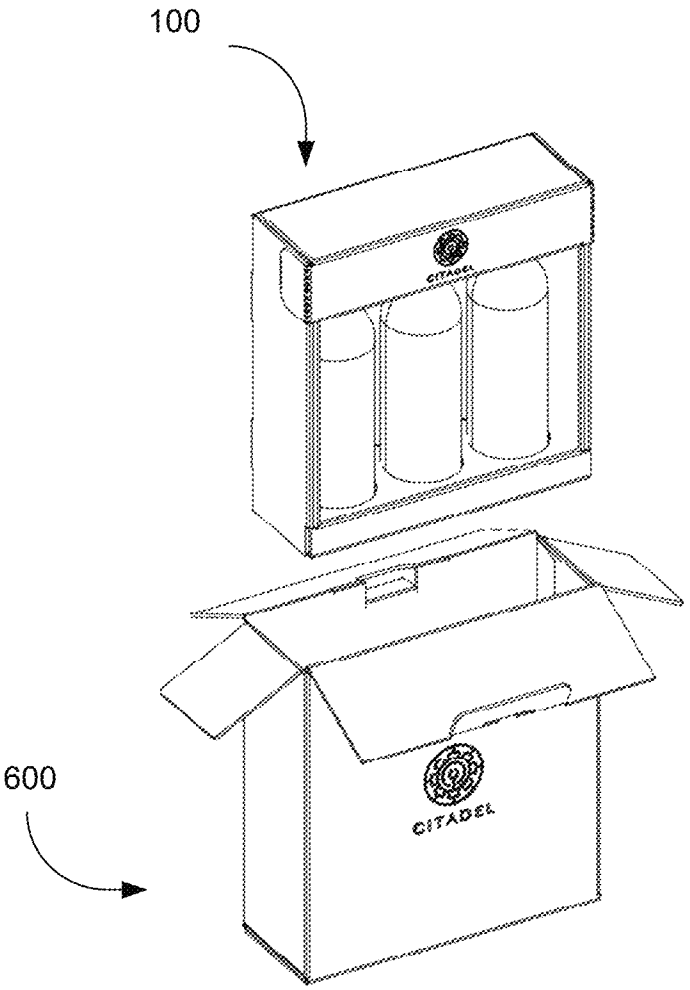
Figure 6D:
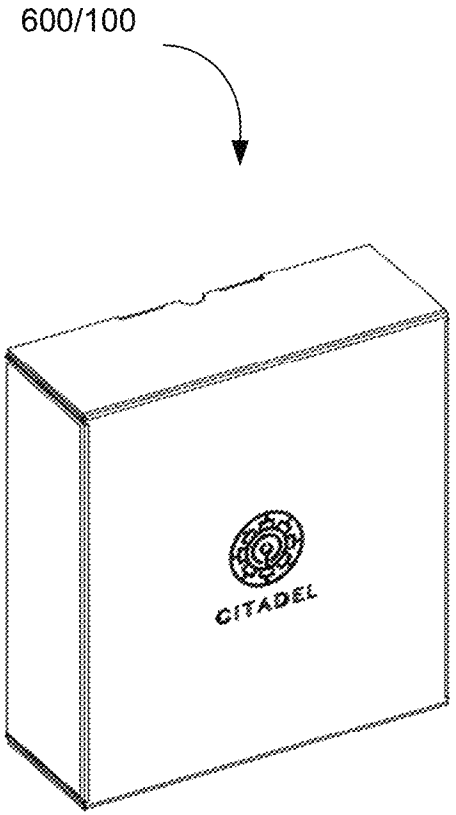
Figure 6C:
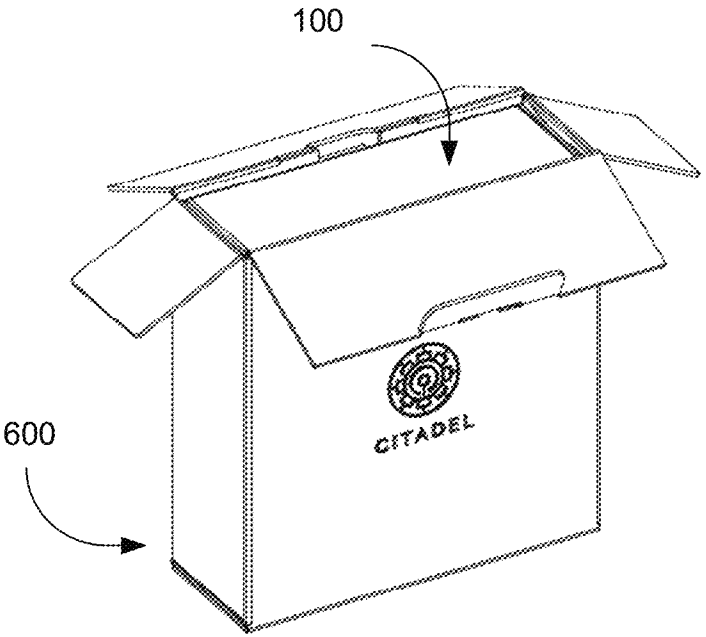

FIG. 5H depicts an example perforation line for the tearable corner 280, as introduced above with reference to FIG. 5C. The upper front panel 206 can include a series of diagonal strips 508 cut into the material of the upper front panel 206. In cases 100 that include this type of perforation, if the upper front panel 206 is pulled open, the connecting sections 510 between the diagonal strips 508 can tear. Once the diagonal strips 508 are cut or torn, the tearable corner 280 will have a noticeably rigid edge, providing visible indication of opening and making it impossible to replace/repair fraudulently without the consumer knowing the case 100 was opened.

FIGS. 6A-6D are perspective views of a case 100 being positioned within an outer box 600, according to some embodiments of the present disclosure. As one aspect of the present designs is to provide a case 100 that enables the contents stored therein to be viewed, an outer box 600 can be provided to ship the products to the end user. This can ensure the contents are protected as the product is handled during shipment.

Aspects of the invention are also provided by the following numbered clauses:

Clause 1: A method for securing a product within a tamper-proof case comprising: folding a first sidewall and a second sidewall inwardly such that the first sidewall and the second sidewall are approximately perpendicular to a back panel; folding a lower foldable section inwardly such that a bottom panel of the lower foldable section is approximately perpendicular to the back panel; folding a bottom flap connected to the bottom panel toward the back panel; folding a lower holder panel of the lower foldable section such the lower holder panel is facing an upper foldable section of the tamper-proof case; folding a first top flap connected to a top panel and a second top flap connected to the top panel inwardly; folding the upper foldable section inwardly such that the top panel is approximately perpendicular to the back panel and the first top flap and the second top flap are positioned interior to the first sidewall and the second sidewall; folding a first sidewall flap inwardly to abut the first top flap; folding a second sidewall flap inwardly to abut the second top flap; folding an upper holder panel inwardly such that the upper holder panel is facing toward the lower foldable section; inserting a bottom of the product into a lower aperture of the lower holder panel; inserting a top of the product into an upper aperture of the upper holder panel; pushing the product toward the back panel such that an upper front panel is approximately coplanar with a lower front panel of the lower foldable section; and securing the product within the tamper-proof case.

Clause 2: The method of Clause 1, wherein securing the product within the tamper-proof case comprises securing the upper foldable section to the first sidewall and the second sidewall.

Clause 3: The method of any of Clauses 1 to 2, wherein securing the product within the tamper-proof case comprises: inserting a first fastener connected to the upper front panel into a first fastener opening disposed within the first sidewall; and inserting a second fastener connected to the upper front panel into a second fastener opening disposed within the first sidewall.

Clause 4: The method of Clause 3, wherein the first fastener comprises a first set of foldable tabs; wherein the second fastener comprises a second set of foldable tabs; and wherein the method further comprises: folding the first set of foldable tabs prior to inserting the first fastener into the second fastener opening; and folding the second set of foldable tabs prior to inserting the second fastener into the second fastener opening.

Clause 5: The method of Clause 4, wherein the first set of foldable tabs unfold subsequent to inserting the first fastener into the second fastener opening to secure the product within the tamper-proof case; and wherein the second set of foldable tabs unfold subsequent to inserting the second fastener into the second fastener opening to secure the product within the tamper-proof case.

Clause 6: The method of any of Clauses 1 to 5, further comprising pulling a tear strip of the upper holder panel to create an opening in the upper aperture.

Clause 7: The method of Clause 6, further comprising tearing a tear corner on the upper front panel; and hinging the upper front panel away from the top of the product.

Clause 8: The method of Clause 7, further comprising pulling the top of the product from the upper aperture.

Clause 9: The method of any of Clauses 1 to 3, wherein securing the product within the tamper-proof case comprises stapling the upper foldable section to the first sidewall and the second sidewall.

Clause 10: The method of any of Clauses 1 to 9, wherein, subsequent to securing the product within the tamper-proof case, the product is separated from the back panel from between 0.5 cm and 1.5 cm.

Clause 11: The method of any of Clauses 1 to 10, wherein the upper front panel and the lower front panel define an observation window when the upper front panel is approximately coplanar with the lower front panel.

Clause 12: The method of Clause 11, wherein a first edge of the observation window is approximately 4.0 cm to approximately 8.0 cm from the bottom panel; and wherein a second edge of the observation window is approximately 4.0 cm to approximately 8.0 cm from the top panel.

Clause 13: The method of any of Clauses 1-12, further comprising: tearing a tear corner on the upper front panel; and hinging the upper front panel away from the top of the product.

It is to be understood that the mention of one or more method steps does not preclude the presence of additional method steps or intervening method steps between those steps expressly identified. It is also to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the public, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. Instead, it is intended that the invention is defined by the claims appended hereto.

What is claimed is:

1. A tamper-proof case comprising:
a back panel;
an upper foldable section comprising:
a top panel foldably connected to the back panel;
an upper front panel foldably connected to the top panel, the upper front panel comprising:
a first foldable fastener; and
a second foldable fastener; and
an upper holder panel foldably connected to the upper front panel and comprising a first upper aperture configured to hold a top of a first product;
a lower foldable section comprising:
a bottom panel foldably connected to the back panel;
a lower front panel foldably connected to the bottom panel; and
a lower holder panel foldably connected to the lower front panel comprising a first lower aperture configured to hold a bottom of the first product;
a first sidewall comprising a first fastener opening configured to accept the first foldable fastener; and
a second sidewall comprising a second fastener opening configured to accept the second foldable fastener,
wherein each of the upper foldable section, the lower foldable section, the first sidewall, and the second sidewall have an open configuration and a closed configuration,
wherein, in their open configurations, the upper foldable section, the lower foldable section, the first sidewall, and the second sidewall are substantially coplanar with the back panel, and
wherein, in their closed configurations, the upper foldable section, the lower foldable section, the first sidewall, and the second sidewall are configured to secure the first product within the tamper-proof case.

2. The tamper-proof case of claim 1 further comprising:
a first top flap foldably connected to the top panel and configured to abut the back panel when the upper foldable section is in the closed configuration; and
a second top flap foldably connected to the top panel and configured to abut the back panel when the upper foldable section is in the closed configuration.

3. The tamper-proof case of claim 1 further comprising:
a first top flap foldably connected to the top panel and configured to abut the back panel when the upper foldable section is in the closed configuration, the first top flap comprising a third fastener opening configured to accept the first foldable fastener; and
a second top flap foldably connected to the top panel and configured to abut the back panel when the upper foldable section is in the closed configuration, the second top flap comprising a fourth fastener opening configured to accept the second foldable fastener.

4. The tamper-proof case of claim 1 further comprising the first product,
wherein the first foldable fastener is connected with the first fastener opening,
wherein the second foldable fastener is connected with the second fastener opening, and
wherein the first product is permanently secured within the first upper aperture and the first lower aperture.

5. The tamper-proof case of claim 1 further comprising a tear strip on the upper holder panel and proximate the first upper aperture and configured to remove a portion of the first upper aperture upon being removed.

6. The tamper-proof case of claim 5 further comprising a first tear corner disposed between the upper front panel and the first foldable fastener and a second tear corner disposed between the upper front panel and the second foldable fastener.

7. The tamper-proof case of claim 1 further comprising a first tear corner disposed between the upper front panel and the first foldable fastener and a second tear corner disposed between the upper front panel and the second foldable fastener.

8. The tamper-proof case of claim 1 further comprising:
a first sidewall flap foldably connected to the first sidewall and comprising a first locking tab configured to extend into a first tab slit disposed in the back panel; and
a second sidewall flap foldably connected to the second sidewall and comprising a second locking tab configured to extend into a second tab slit disposed in the back panel.

9. The tamper-proof case of claim 1 wherein the upper foldable section is permanently attached to the first sidewall and the second sidewall when the upper foldable section, the first sidewall, and the second sidewall are in their closed configurations.

10. The tamper-proof case of claim 1 further comprising:
a lower pad adhered to the bottom panel;
an upper pad adhered to the top panel;
a lower aperture pad adhered to the lower holder panel; and
an upper aperture pad adhered to the upper holder panel.

11. The tamper-proof case of claim 1, wherein:
the upper holder panel further comprises a second upper aperture configured to hold a top of a second product; and
the lower holder panel further comprises a second lower aperture configured to hold a bottom of the second product,
wherein, in their closed configurations, the upper foldable section, the lower foldable section, the first sidewall, and the second sidewall are configured to secure the second product within the tamper-proof case.

12. The tamper-proof case of claim 1, wherein:
the lower front panel further comprises:
a first foldable fastener; and
a second foldable fastener;
the first sidewall comprises a first fastener opening configured to accept the first foldable fastener; and
the second sidewall comprises a second fastener opening configured to accept the second foldable fastener.

13. The tamper-proof case of claim 1, wherein at least one of the first upper aperture or the first lower aperture comprises a plurality of aperture fingers.

14. A tamper-proof case comprising:
a back panel;
an upper foldable section comprising:
a top panel foldably connected to the back panel;
an upper front panel foldably connected to the top panel; and an upper holder panel foldably connected to the upper front panel and comprising a first upper aperture configured to hold a top of a first product;

a lower foldable section comprising:

a bottom panel foldably connected to the back panel;

a lower front panel foldably connected to the bottom panel; and a lower holder panel foldably connected to the lower front panel comprising a first lower aperture configured to hold a bottom of the first product;

a first sidewall;

a second sidewall;

a first sidewall flap foldably connected to the first sidewall and comprising a first locking tab configured to extend into a first tab slit disposed in the back panel; and a second sidewall flap foldably connected to the second sidewall and comprising a second locking tab configured to extend into a second tab slit disposed in the back panel, wherein each of the upper foldable section, the lower foldable section, the first sidewall, and the second sidewall have an open configuration and a closed configuration, wherein, in their open configurations, the upper foldable section, the lower foldable section, the first sidewall, and the second sidewall are substantially coplanar with the back panel, and wherein, in their closed configurations, the upper foldable section, the lower foldable section, the first sidewall, and the second sidewall are configured to secure the first product within the tamper-proof case.

15. The tamper-proof case of claim 14 further comprising:

a first top flap foldably connected to the top panel and configured to abut the back panel when the upper foldable section is in the closed configuration; and a second top flap foldably connected to the top panel and configured to abut the back panel when the upper foldable section is in the closed configuration.

16. The tamper-proof case of claim 14, wherein:

the upper front panel further comprises:

a first foldable fastener; and a second foldable fastener;

the first sidewall comprises a first fastener opening configured to accept the first foldable fastener; and the second sidewall comprises a second fastener opening configured to accept the second foldable fastener.

17. The tamper-proof case of claim 16 further comprising:

a first top flap foldably connected to the top panel and configured to abut the back panel when the upper foldable section is in the closed configuration, the first top flap comprising a third fastener opening configured to accept the first foldable fastener; and a second top flap foldably connected to the top panel and configured to abut the back panel when the upper foldable section is in the closed configuration, the second top flap comprising a fourth fastener opening configured to accept the second foldable fastener.

18. The tamper-proof case of claim 16 further comprising the first product, wherein the first foldable fastener is connected with the first fastener opening, wherein the second foldable fastener is connected with the second fastener opening, and wherein the first product is permanently secured within the first upper aperture and the first lower aperture.

19. The tamper-proof case of claim 16 further comprising a tear strip on the upper holder panel and proximate the first upper aperture and configured to remove a portion of the first upper aperture upon being removed.

20. The tamper-proof case of claim 19 further comprising a first tear corner disposed between the upper front panel and the first foldable fastener and a second tear corner disposed between the upper front panel and the second foldable fastener.

* * * * *